US012213632B2

(12) United States Patent
Wegelin et al.

(10) Patent No.: US 12,213,632 B2
(45) Date of Patent: Feb. 4, 2025

(54) DISPENSING SYSTEM WITH MATERIAL LEVEL DETECTOR

(71) Applicant: GOJO Industries, Inc., Akron, OH (US)

(72) Inventors: Jackson William Wegelin, Stow, OH (US); Nick Ermanno Ciavarella, Seven Hills, OH (US); Scott Theodore Proper, Stow, OH (US); Richard E. Corney, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 262 days.

(21) Appl. No.: 17/556,297

(22) Filed: Dec. 20, 2021

(65) Prior Publication Data

US 2022/0183511 A1 Jun. 16, 2022

Related U.S. Application Data

(60) Continuation of application No. 15/918,241, filed on Mar. 12, 2018, now Pat. No. 11,202,535, which is a division of application No. 14/620,149, filed on Feb. 11, 2015, now Pat. No. 9,913,562.

(60) Provisional application No. 61/938,643, filed on Feb. 11, 2014.

(51) Int. Cl.
*A47K 5/12* (2006.01)

(52) U.S. Cl.
CPC ..... *A47K 5/1217* (2013.01); *A47K 5/1202* (2013.01); *A47K 5/1211* (2013.01); *A47K 2005/1218* (2013.01)

(58) Field of Classification Search
CPC .. A47K 5/1217; A47K 5/1202; A47K 5/1211; A47K 2005/1218; A47K 5/16; B67D 2001/1259; B67D 2001/1263; B67D 2001/1265; B67D 2001/1268
See application file for complete search history.

(56) References Cited

U.S. PATENT DOCUMENTS 5,356,051 A * 10/1994 Azuma ..... A47K 5/14 222/401
5,781,942 A * 7/1998 Allen ..... E03C 1/057 4/628
2005/0133100 A1* 6/2005 Bolderheij ..... E03C 1/0404 137/801

(Continued)

OTHER PUBLICATIONS

First Examination Report received in corresponding Canadian patent application No. 3,189,390, dated Jun. 13, 2024, 5 pages.

*Primary Examiner* — Vishal Pancholi
(74) *Attorney, Agent, or Firm* — Cooper Legal Group, LLC

(57) ABSTRACT

A dispensing system comprises a first electronic sensor and a controller. The first electronic sensor may be configured to detect a first change from a first amount of a fluid product in a dispensing system reservoir to a second amount of the fluid product in the dispensing system reservoir. The controller may be coupled to the first electronic sensor and configured to receive a first signal from the first electronic sensor indicative of the first change. The dispensing system reservoir may be disposed in the dispensing system. A method for determining a remaining service interval for a dispensing system reservoir is also provided.

20 Claims, 18 Drawing Sheets

(56) References Cited

U.S. PATENT DOCUMENTS

| | | | | |
|---|---|---|---|---|
| 2012/0058025 | A1* | 3/2012 | Fienup | A47L 15/44<br>73/861.08 |
| 2013/0098941 | A1* | 4/2013 | Wegelin | A47K 5/1205<br>222/23 |

* cited by examiner

DISPENSING SYSTEM WITH MATERIAL LEVEL DETECTOR

RELATED APPLICATIONS

This application claims priority to and is a continuation application of Ser. No. 15/918,241, filed on Mar. 12, 2018 and titled "DISPENSING SYSTEM WITH MATERIAL LEVEL DETECTOR," which claims priority to and is a divisional of Ser. No. 14/620,149, filed on Feb. 11, 2015 and titled "DISPENSING SYSTEM WITH MATERIAL LEVEL DETECTOR," which claims priority to and is a non-provisional of U.S. Provisional Application 61/938,643, titled "DISPENSER WITH MATERIAL LEVEL DETECTOR" and filed on Feb. 11, 2014, both of which are incorporated herein by reference.

TECHNICAL FIELD

The instant application relates to the field of dispensing systems and dispensing indication systems. More particularly, the application relates to methods and devices for inventory control and efficient route planning for the supply and maintenance of dispensing systems. More specifically, the application relates to monitoring devices and methods for indicating whether a fluid product in a dispensing system requires or will require replacement.

BACKGROUND

A dispensing system may store and selectively dispense a fluid product (e.g., soap, hand sanitizer, cleaners, disinfectants, moisturizers etc.). As such, dispensing systems are commonly used in a number of different environments to improve sanitation and cleanliness, for example. Dispensing systems may be used, for example, in schools, hospitals, factories, restaurants, airports, banks, grocery stores, etc., whereupon a user of the dispensing system may clean his/her hands, clean an area within one of these environments, and/or the like.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a dispensing system comprises a first electronic sensor and a controller. The first electronic sensor is configured to detect a first change from a first amount of a fluid product in a dispensing system reservoir to a second amount of the fluid product in the dispensing system reservoir. The controller is coupled to the first electronic sensor and is configured to receive a first signal from the first electronic sensor indicative of the first change.

In an example, a dispensing system comprises a first electronic sensor, a second electronic sensor, and a controller. The first electronic sensor is configured to detect a first change from a first amount of a fluid product in a dispensing system reservoir to a second amount of the fluid product in the dispensing system reservoir. The second electronic sensor is configured to detect a second change from the first amount of the fluid product to a third amount of the fluid product. The controller is coupled to the first electronic sensor and the second electronic sensor and is configured to receive at least one of a first signal from the first electronic sensor indicative of the first change or a second signal from the second electronic sensor indicative of the second change.

In another example, a method of determining a remaining service interval of a dispensing system reservoir comprises determining an average usage rate for a dispensing system by monitoring a number of dispersions over a period of time. The method also comprises detecting a real time amount of fluid product in the dispensing system reservoir by detecting a first change from a first amount of fluid product in the dispensing system reservoir to a second amount of the fluid product in the dispensing system reservoir. The method also comprises determining the remaining service interval of the dispensing system reservoir based upon the average usage rate and the real time amount of the fluid product in the dispensing system reservoir.

The following description and annexed drawings set forth certain illustrative aspects and implementations. These are indicative of but a few of the various ways in which one or more aspects may be employed. Other aspects, advantages, and/or novel features of the disclosure will become apparent from the following detailed description when considered in conjunction with the annexed drawings.

DETAILED DESCRIPTION

Figure 1:
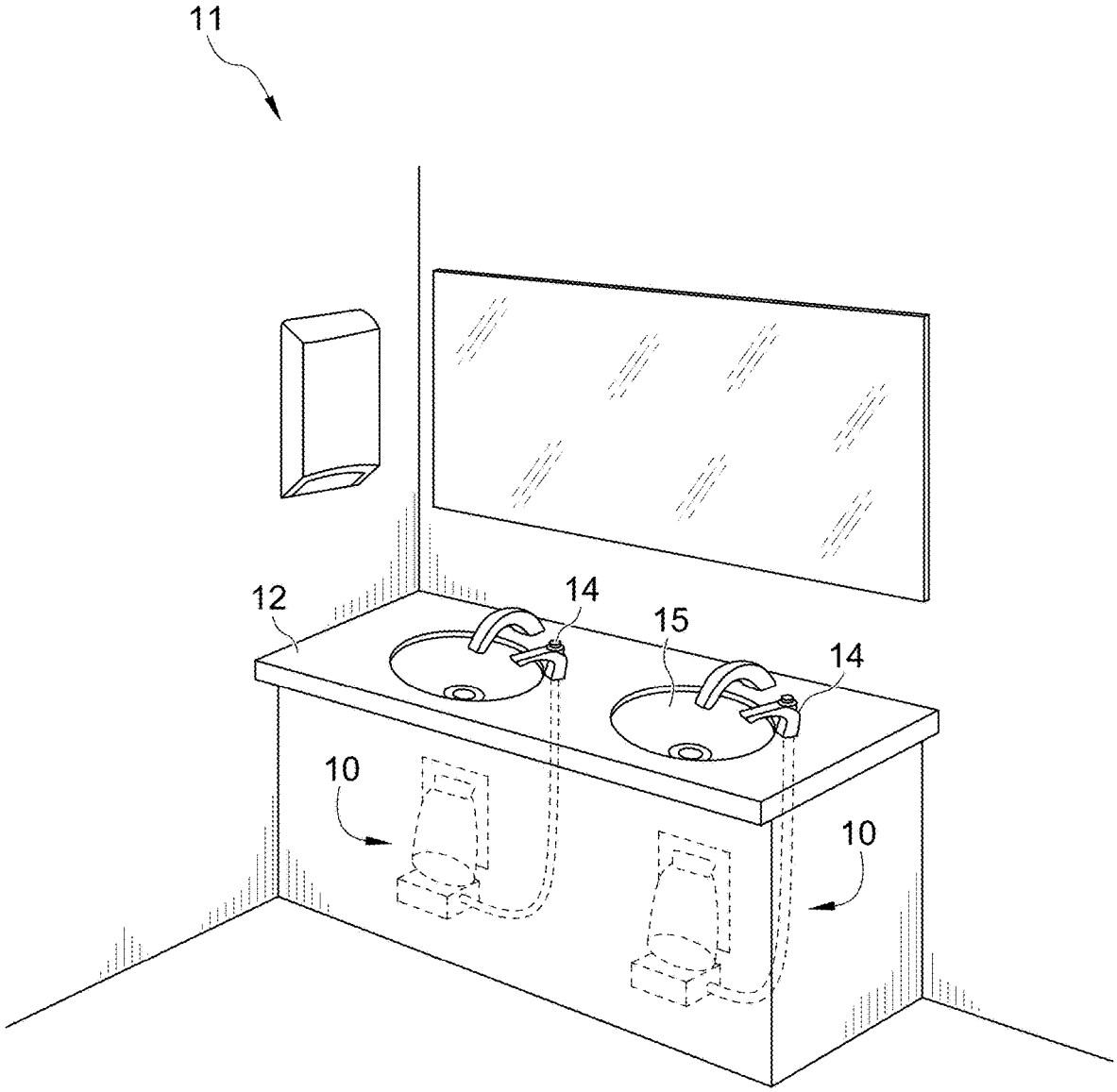
FIG. 1 is an illustration of an example of a dispensing system according to some embodiments.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter may be practiced without these specific details. In other instances, structures and devices are illustrated in block diagram form in order to facilitate describing the claimed subject matter.

FIG. 1 illustrates an example 11 of a dispensing system 10 for dispensing a material, such as a fluid product. The dispensing system 10 may be configured to dispense a measured and/or predetermined amount of the fluid product to a user. In an example, the fluid product may comprise a hand care product such as soap, lotion, hand sanitizer, and/or other suitable types of liquid and/or foam products that may be similarly dispensed from the dispensing system 10.

Figure 2:
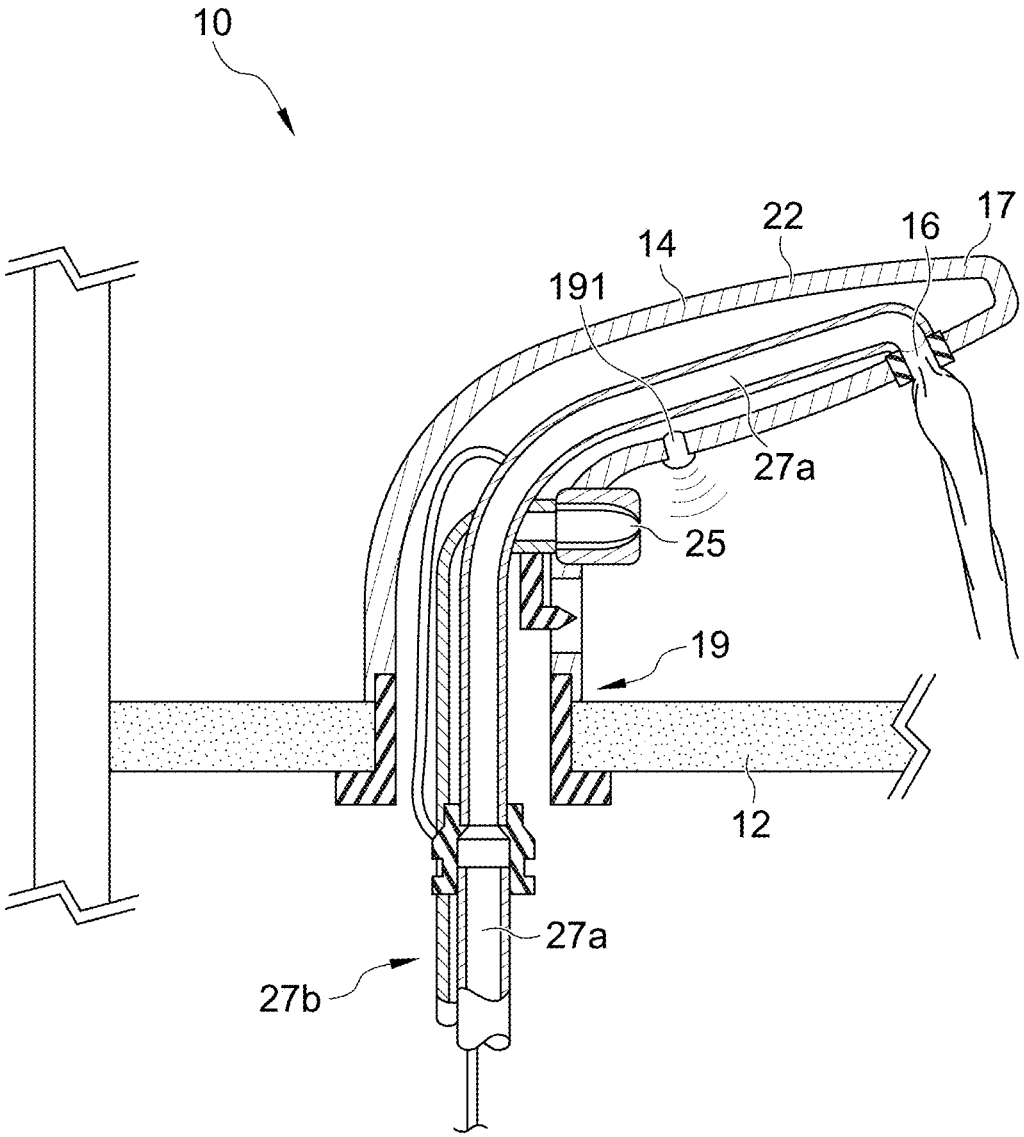
FIG. 2 is an illustration of an example of a cross sectional view of a fixture of the dispensing system according to some embodiments.
Figure 3:
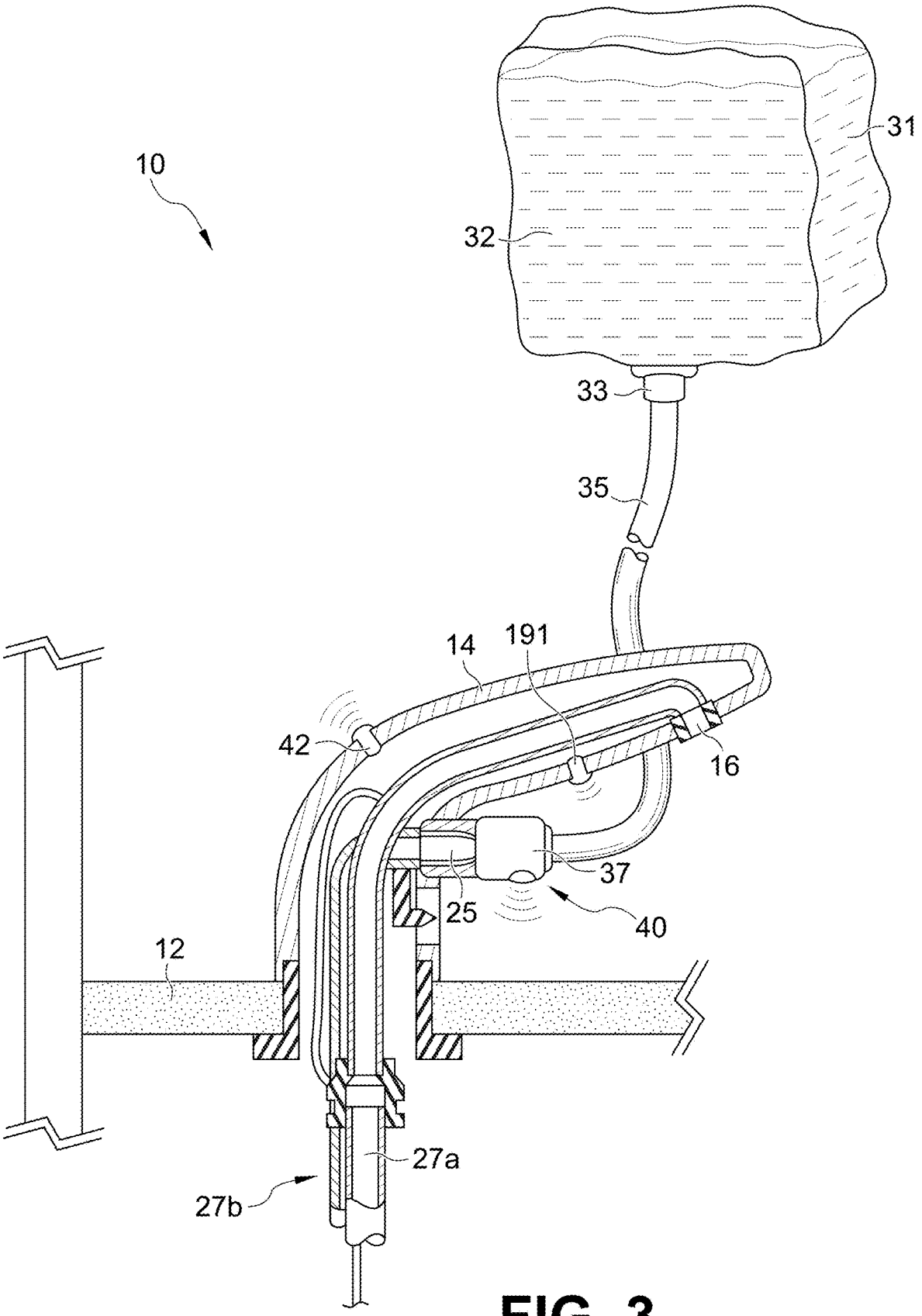
FIG. 3 is an illustration of an example of a cross sectional view of the fixture of the dispensing system shown in FIG. 2 attached to a refill unit, according to some embodiments.

As illustrated by FIGS. 2 and 3, the dispensing system 10 may comprise a fixture 14 (e.g., a rigid fixture, such as a faucet) having a nozzle 16, such as for dispensing fluid products, received in an end 17 of the fixture 14. In an example, the fixture 14 may be constructed from impact resistance plastic and/or corrosion resistant metal. The fixture 14 may be mounted to a supporting structure 12, such as a countertop, and/or positioned adjacent a water source, such as sink 15 (illustrated in FIG. 1). In another example, the fixture 14 may be mounted to other types of supporting structures, such as a wall, a dispenser stand, a mirror, a cabinet (e.g., under cabinets, sinks, etc.), etc. The fixture 14 may have a faucet-like configuration including a base 19 for mounting the fixture 14 to the supporting structure 12. The fixture 14 may comprise an outwardly extending cantilevered arm 22. The nozzle 16 may be positioned at the end 17 of the outwardly extending cantilevered arm 22. Conduits, such as a first conduit 27*a* and/or a second conduit 27*b*, may be fluidly connected to a source of the fluid product, such as a dispensing system reservoir 60 (illustrated in FIG. 4).

In an example, the fixture 14 may be at least partially hollow. The fixture 14 may comprise one or more generally concave parts that fastened together to form a fixture assembly. For example, one or more of the concave parts may be affixed together utilizing fasteners, epoxies, welds, and/or other means capable of affixing the concave parts together securely. In an example, the first conduit 27*a* and/or the second conduit 27*b* may be received in the hollow interior of the fixture 14. By locating the conduits 27*a*-27*b* within the hollow interior of the fixture 14, the conduits 27*a*-27*b* may be protected from damage, such as from a user coming in direct contact with the conduits 27*a*-27*b* (e.g., during use of the dispensing system 10, during maintenance of the dispenser system 10, etc.). In another embodiment, the fixture 14 may be generally solid with a fluid channel and/or conduit molded and/or machined directly within the fixture 14.

Figure 4:
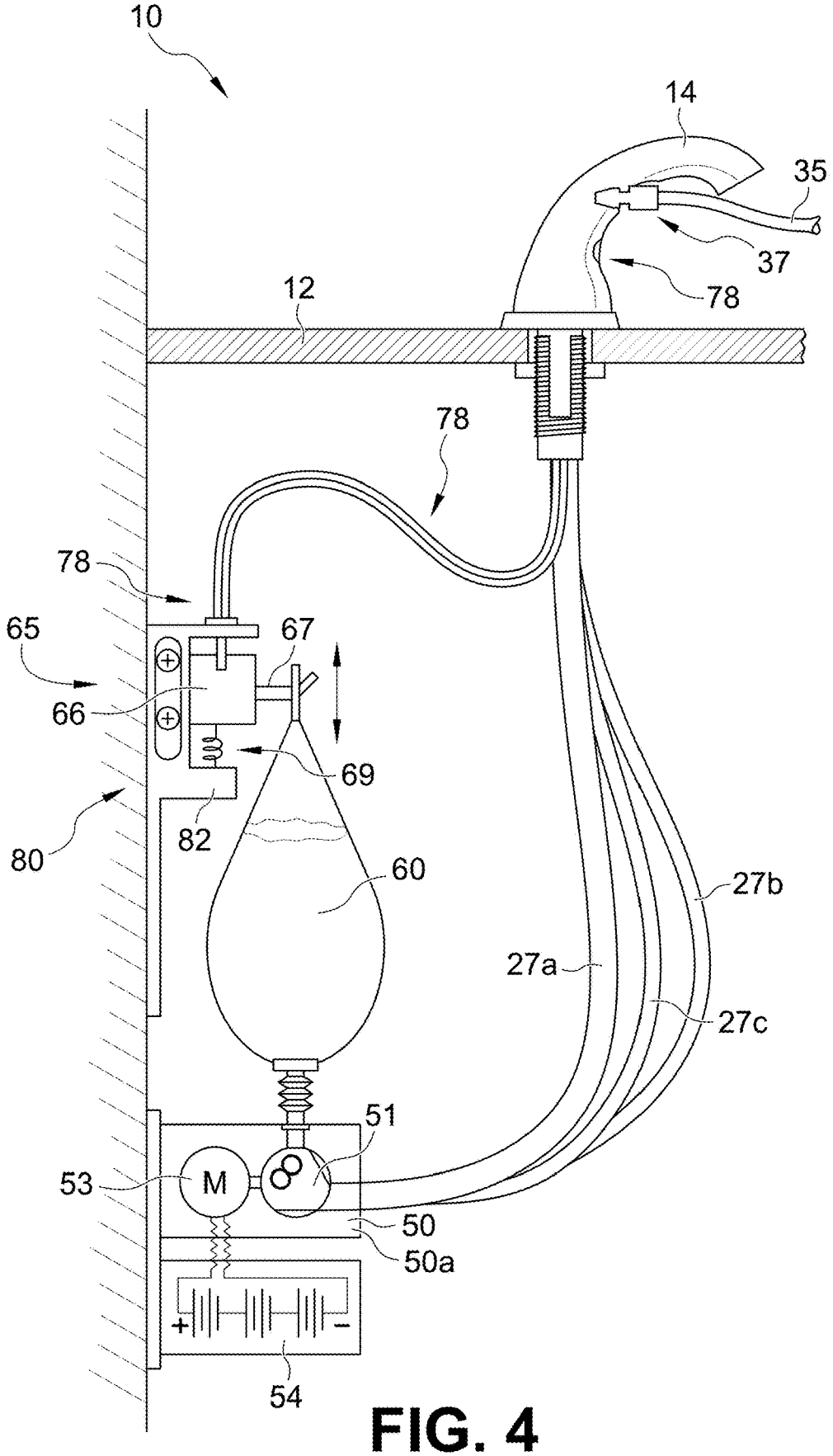
FIG. 4 is an illustration of an example of a schematic representation of the dispensing system showing the weighing system and dispensing system reservoir, according to some embodiments.

As illustrated in FIG. 4, the first conduit 27*a* and/or the second conduit 27*b* may be configured to channel the fluid product from the dispensing system reservoir 60 to the nozzle 16 for dispersion to the user. In another embodiment, the first conduit 27*a* and/or the second conduit 27*b* may be configured to channel the fluid product from the nozzle 16 to the dispensing system reservoir 60 to refill the dispensing system reservoir 60 (e.g., a refill container may be connected to the nozzle 16 to provide additional fluid product to the dispensing system reservoir 60 through the conduits). In an example, the first conduit 27*a* may be connected at a first end to the nozzle 16 and a second end of first conduit 27*a* may terminate at a manifold 50. The second conduit 27*b* may be connected to the manifold 50 and terminate at a refill connection port 25 mounted onto the fixture 14. The manifold 50 may comprise a selectively activated valve which may be utilized to switch between conduits 27*a*-27*b* in response to an action being performed (e.g., dispensing action, refill action, etc.). The manner by which the dispensing system 10 is replenished with the fluid product should not be construed as limiting. Other methods, such as for example replacing the dispensing system reservoir 60, may be employed without departing from the intended scope of the instant application.

Still referring to FIG. 4, the dispensing system 10 may comprise a third conduit 27*c*. In an example, conduits 27*a* and 27*b* may be configured to channel the fluid product to and/or from the dispensing system reservoir 60 and the third conduit 27*c* may be configured to carry a gas, such as air, nitrogen, carbon dioxide, etc. The dispensing system 10 may infuse the gas into the fluid product to produce a foam. In an example, soap may be infused with air to create foam that may be dispensed from the nozzle 16 by the dispensing system 10. The air infused into the soap may be obtained directly from the atmosphere and/or through a filter (not illustrated) to limit and/or mitigate the generation of biofilms within the dispensing system 10. In another embodiment, gases, such as carbon dioxide, may be obtained from a refillable and/or disposable gas canister (not illustrated).

With reference to FIGS. 2, 3, and 4, the refill connection port 25 may provide a fluid and/or air tight inlet. In an example, the refill connection port 25 may be configured to connect to a refill container 31, illustrated in FIG. 3. Responsive to not being in use, the refill connection port 25 may be closed off from exposure to the atmosphere. In an example, the refill connection port 25 may comprise a quick connect fitting. In this way, the fluid product may be permitted to flow through the refill connection port 25 in response to a mating connector 37 from the refill container 31 being connected thereto. Likewise, the fluid product may be prohibited from flowing through the refill connection port 25 in response to the mating connector 37 not being connected thereto. In another example, a cap secured by threads (not illustrated) may be utilized to seal the refill connection port 25. Although, any other type of refill connection port 25 may be used that inhibits and/or substantially mitigating fluid product from being exposed to the atmosphere.

In an example, the refill container 31 may store a predetermined amount (e.g., known amount) of fluid product in a refill storage area 32. A volume of the refill storage area 32 may be substantially equivalent to the storage capacity of the dispensing system reservoir 60. In this way, less fluid product may be left over and/or wasted when the refill container 31 refills the dispensing system 10. However, other volumes of refill storage area 32 may be used without limiting the scope of coverage of the embodiments described herein.

In an example, the refill container 31, such as a refill bag, may be constructed from pliable plastic material. In this way, as the fluid product flows from the refill container 31, walls of the refill container 31 may collapse providing for effective disposal of the refill container 31. In an example, the refill container 31 may comprise a connection fitting 33. The connection fitting 33 may be affixed to an aperture formed in the refill container 31 via any process known in the art, as long as a substantially fluid tight seal is formed. In an example, a first end of a hose 35 may be connected to the connection fitting 33 and a second end of the hose 35 may be connected to the mating connector 37. The hose 35 may be configured to establish fluid product flow between the refill container 31 and the refill connection port 25 of the dispensing system 10. In an example, the connection fitting 33 and/or the mating connector 37 may comprise quick connect fittings configured to efficiently mate with the refill connection port 25 and/or the refill container 31. However, any type of fittings may be used as is necessary to provide a connection that mitigates or inhibits the fluid product from being exposed to air.

Referring back to FIG. 3, a validation key or tag may be implemented between the refill container 31 and the dispensing system 10 for validating the contents of the refill container 31. In an example, the mating connector 37 may comprise an electronic key 40. The electronic key 40 may comprise an RFID (Radio Frequency Identification) tag. The RFID tag may be passive and/or active. A corresponding interrogator 42 may be mounted to the fixture 14 and positioned proximal to the refill connection port 25. In an example, responsive to the mating connector 37 being brought near and/or installed onto the refill connection port 25, the interrogator 42 may automatically "ping" (e.g., initiate a RFID identification protocol) the electronic key 40 to verify that the correct refill container 31 is being used. In response to an incorrect refill container being connected to the dispensing system 10, a control system may be configured to not initiate a refilling sequence. In an example, depending on a range, i.e. strength, of the RFID signal, the interrogator 42 may be mounted onto a circuit board located in the control system and/or elsewhere in the dispensing system 10. Skilled artisans will appreciate that other forms of tagging, i.e. verification, may be used, like for example keyed mechanical fittings and/or optical sensor systems. Still, any manner that inhibits the dispensing system 10 from working with the improper refill container 31 may be utilized by the dispensing system 10.

Figure 5:
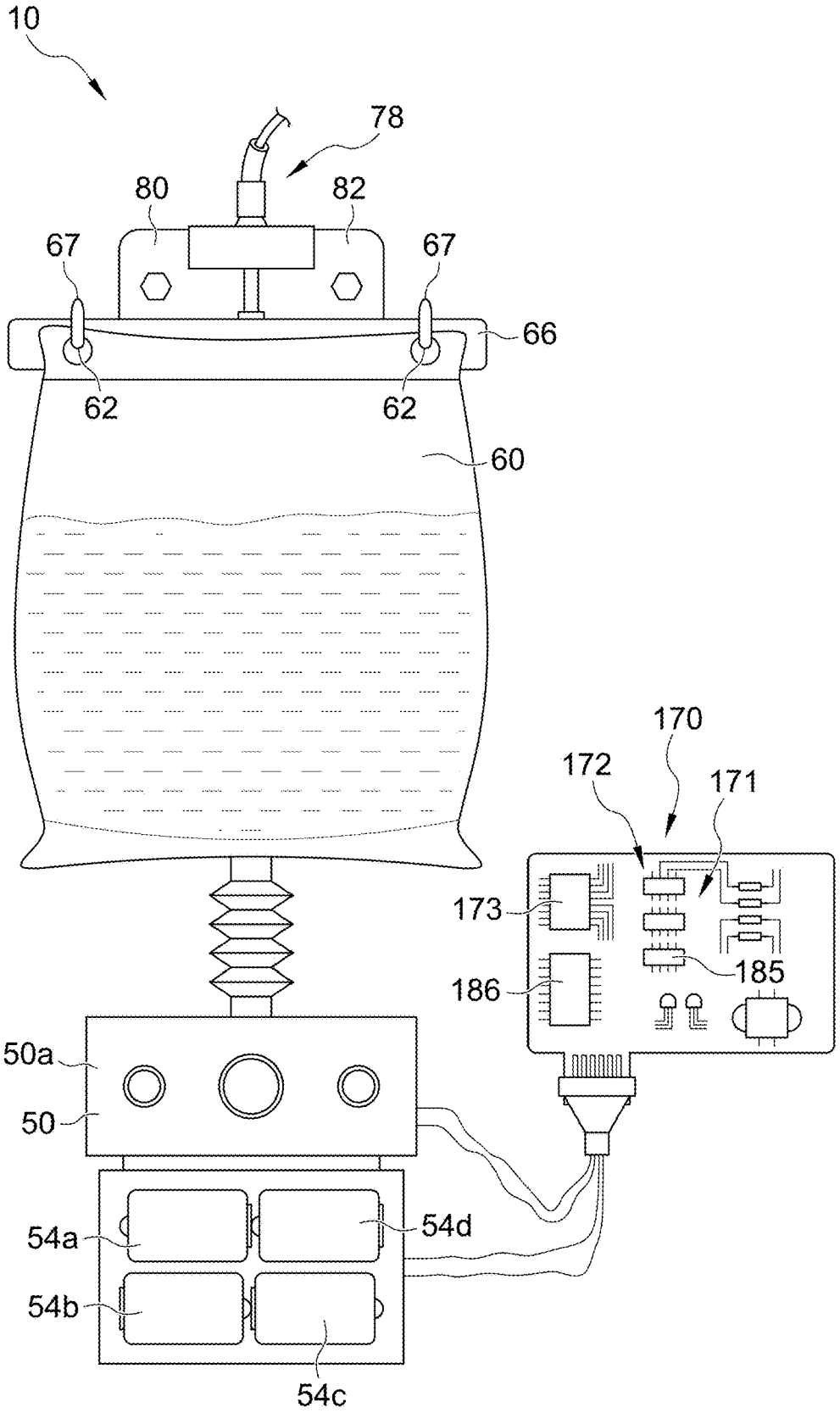
FIG. 5 is an illustration of an example of a front elevation view of the dispensing system reservoir and schematic representation of the control system, according to some embodiments.

Turning to FIGS. 4 and 5, the conduits 27*a*-27*c* may be connected to the manifold 50. The manifold 50 may function to direct the fluid product to and/or from the dispensing system reservoir 60. While the manifold 50 is schematically depicted as a block, any configuration and/or design of the manifold 50 may be chosen with sound engineering judgment. For example, the manifold 50 may incorporate one or more valves, such as check valves (not shown), to promote fluid product flow to the nozzle 16 and/or from the refill connection port 25. Persons of skill in the art will see other ways of constructing the manifold 50. In that the design and use of manifolds to direct fluid flow is known in the art, no further explanation will be offered at this point.

A pump 51 may be utilized to create and/or apply pressure within the dispensing system 10, as illustrated in FIG. 4. In an example, the pump 51 may create positive pressure and/or negative pressure (vacuum) to move the fluid product through at least one of the conduits 27*a*-27*c*. The pump 51 may comprise a gear pump, although other types of pumping mechanisms including but not limited to piston pumps and/or reciprocating pumps may be employed by the dispensing system 10. In an example, the pump 51 may be connected to the manifold 50 by conduits (not illustrated). In another example, the pump 51 may be incorporated directly into manifold block 50*a* of the manifold 50. During a dispensing event (e.g., dispensing of the fluid product in response to the actuation of the pump 51), positive pressure may be generated to force the fluid product through the first conduit 27*a* to the nozzle 16. Similarly, gas used to create foam at the nozzle 16 may be drawn directly by the pump 51 and/or indirectly via a venturi effect, for example. During a refill event, negative vacuum pressure may be produced in the second conduit 27*b* to draw the fluid product from the refill container 31 into the dispensing system reservoir 60.

In an example, a motor 53 may drive the pump 51. The motor 53 may be a direct current (DC) motor and/or an alternating current (AC) motor (e.g., operated off of AC power). Responsive to AC power being available on site (e.g., the location of the dispensing system 10) from a facility, an AC motor may be utilized by the dispensing system 10. Responsive to power not being available and/or readily accessible on site, power may be provided by way of an onboard power source, such as a battery 54 and/or a photoelectric cell (e.g., solar power), not illustrated. In an example, the onboard power source may comprise of one or more of D-cell batteries 54*a*-54*d*, illustrated by FIG. 5.

With continued reference to FIGS. 4 and 5, the dispensing system reservoir 60 may be mounted in operational proximity to the manifold 50. In an example, the operational proximity may be less than five feet. The dispensing system reservoir 60 may be configured to provide remote storage for the fluid product and may be refilled in a manner consistent with that previously described. In an example, the dispensing system reservoir 60 may be constructed from polymeric sheet-like material, such as a reservoir bag. The sheet-like material may be generally pliable and/or transparent to allow users and/or service personnel to visually see into the dispensing system reservoir 60. In another example, the sheet-like material of the dispensing system reservoir 60 may comprise an opaque material. Responsive to the material forming the dispensing system reservoir 60 being pliable, the dispensing system reservoir 60 may collapse as the fluid product is drained (e.g., dispensed) from the dispensing system reservoir 60. Accordingly, gas does not need to be introduced into the dispensing system 10, and more specifically into the dispensing system reservoir 60, to displace the fluid product, thereby mitigating and/or reducing the formation of bio-films.

In another example, the dispensing system reservoir 60 may comprise a rigid and/or semi-rigid material. For example, the dispensing system reservoir 60 may comprise a box and/or bottle. In an example, an air inlet may be incorporated in the dispensing system reservoir 60, one or more of the conduits 27*a*-27*c*, and/or the manifold 50 to inhibit a vacuum from forming in the dispensing system reservoir 60. The inlet, not shown, may allow air to displace the fluid product during the dispensing event. In an example, an air filter may be used to clean the air introduced into the dispensing system 10.

Still referencing FIGS. 4 and 5, a weighing system 65 may be provided for determining the weight of the fluid product within the dispensing system reservoir 60 and/or a change in the weight of the fluid product within the dispensing system reservoir 60. By detecting the weight and/or the change in weight for the fluid product, a level and/or volume corresponding to the fluid product may be determined (e.g., a real time amount of a fluid product may be determined), which may be utilized to indicate a remaining service interval to the user (e.g., service personnel). The service interval may indicate to the user when the fluid product of the dispensing system 10 needs to be replenished. In an example, an indicator and/or an indicating system 78, illustrated in FIG. 6 and discussed below, may be connected to the weighing system 65 (e.g., the indicating system 78 may be configured to indicate to the user the level of fluid product currently in the dispensing system reservoir 60 and/or indicate a time period when the dispensing system reservoir 60 may need to be refilled).

In an example, the weighing system 65 may comprise a mounting block 66 and/or a weight differentiating element 69 disposed between the mounting block 66 and a stable surface, such as the ground. In an example, the weight differentiating element 69 may comprise a spring 70 positioned between the mounting block 66 and a mounting bracket 82 (e.g., a wall mounting bracket). The spring 70 may be designed to support the weight of the dispensing system reservoir 60 when filled with the fluid product. Stated otherwise, the spring 70 does not "bottom out" when the dispensing system reservoir 60 is filled to capacity. In this way, the spring 70 may store potential energy corresponding to the volume and/or level of the fluid product in the dispensing system reservoir 60, which may be displayed to the user. In an example, the mounting block 66 may be movably connected with respect to the mounting bracket 82. To facilitate movement, the mounting block 66 may include a slide element and/or roller elements (e.g., rails) that fit into one or more slots of the mounting bracket 82, for example.

Figure 6:
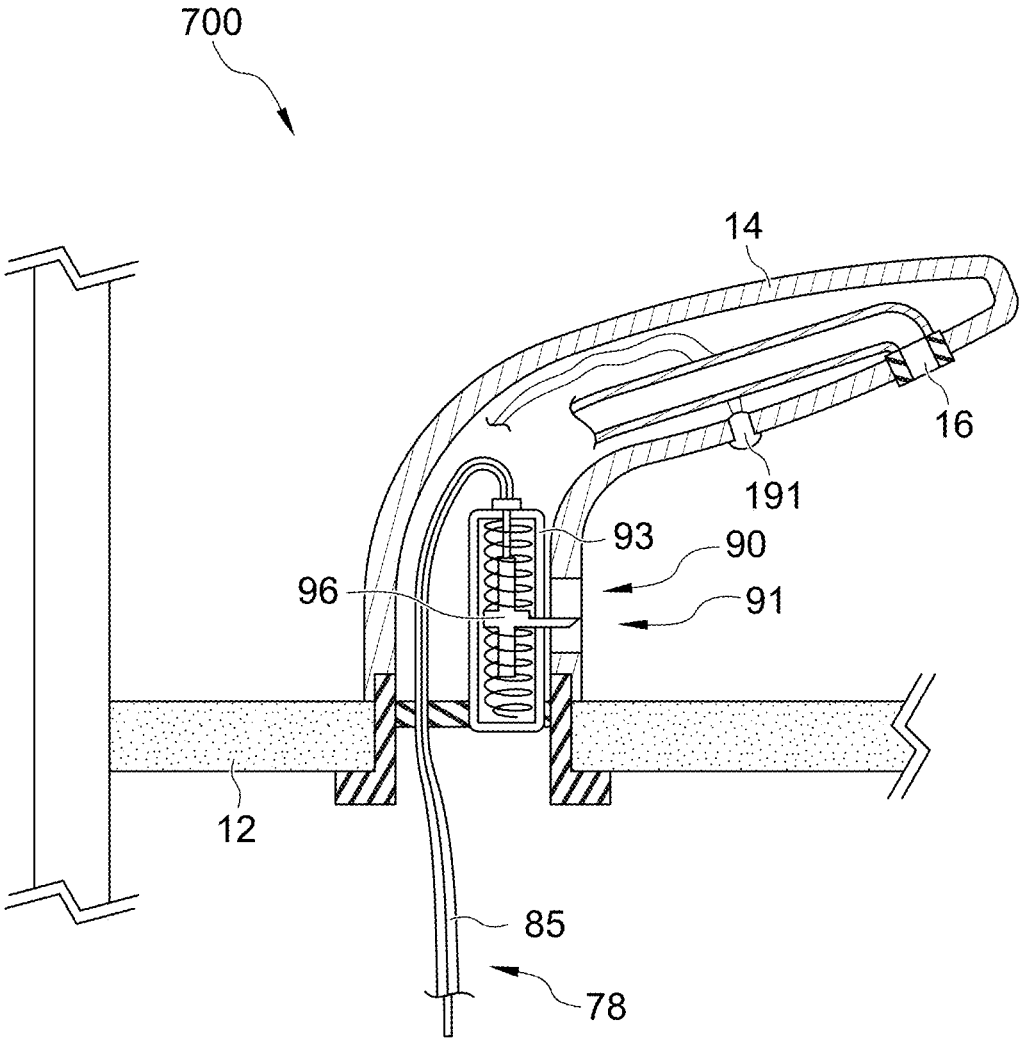
FIG. 6 is an illustration of an example of a cross sectional view of the fixture of the dispensing system showing the mechanical indicating system, according to the embodiments of the subject disclosure.

With continued reference to FIGS. 4 and 5, and now also to FIG. 6, as mentioned above, the weighing system 65 may be connected to the indicating system 78 for the purpose of displaying the amount (e.g., level, volume, weight, etc.) of the fluid product remaining in the dispensing system reservoir 60, for example. The weight differentiating element 69 may be connected to the indicating system 78 so that as the amount of fluid product decreases, such as with respective dispensing cycles, a signal is transmitted thereby indicating the fluid level status. The signal may be analog in nature (e.g., the signal may be infinitely positionable) and/or the signal may be digital in nature. In an example, the signal may comprise a Bluetooth signal, a Wi-Fi signal, cellular signal, an RFID signal, and/or a combination thereof. For example, the indicating system 78 may comprise a Bluetooth transmitter and/or a Wi-Fi hub/gateway. The Bluetooth transmitter may be configured to transmit a low power Bluetooth signal to the Wi-Fi hub/gateway, which in turn may provide the fluid status level to the user through an internet connection.

In an example, the weight differentiating element 69 may be connected to a mechanical push-pull cable 85. The mechanical push-pull cable 85, also referred to herein as the cable assembly, may comprise an outer sheath and/or an internal flexible cable. In an example, the mechanical push-pull cable 85 may transmit compression and/or tension forces. For example, an outer sheath of the mechanical push-pull cable 85 may be affixed to a grounded structure 80, such as mounting bracket 82, to indicate the fluid level, etc. based upon the compression and/or tension forces. In a like manner, an internal cable may be affixed to the mounting block 66. Since the mounting block 66 is movably connected to the weight differentiating element 69, namely spring 70, changes in the weight of the dispensing system reservoir 60 may cause the weight differentiating element 69 to move the internal cable (e.g., with respect to the outer sheath).

Still referring to FIG. 6, a distal end of the mechanical push-pull cable 85 may be connected to a display 90. In an example, the display 90 may be connected to the fixture 14. In another example, the display 90 may be remotely located away from the fixture 14, such as in a control room or on a wall proximate the fixture 14. The display 90 may comprise a visual indicator, such as a mechanical flag, a light, and/or an electronic read out. In another example, the indicating system 78 may transmit an audible indicator, a tactile indicator (e.g., a vibration indication produced when the user comes into contact with part of the dispensing system 10, and/or a wireless communication indication (e.g., a notification sent to a smartphone of the user in response to the user entering within a threshold distance, etc.)).

For illustrative purposes, the display 90 will be described as a mechanical level indicator 91, which comprises a stationary housing 93 and/or a reciprocating, or otherwise movable, flag 96. In one embodiment, the stationary housing 93 is securely fastened to the fixture 14. The sheath of the cable assembly may be affixed to the stationary housing 93 and the mechanical push-pull cable 85 may be connected to the flag 96. In this way, a change in the weight of the dispensing system reservoir 60 may push and/or pull on the mechanical push-pull cable 85. As such, the flag 96 may correspondingly move to visually indicate the change in the amount of fluid product remaining in the dispensing system reservoir 60. The position of the flag 96 may be viewed by user through a transparent cover incorporated into the fixture 14, such as at the mounting site of the mechanical level indicator 91. In another example, the display 90 may comprise an electrical display comprising an electronic readout configured to visually indicate the level of the fluid product within the dispensing system reservoir 60 (e.g., the level of the fluid product may be determined based upon weight differentiating element 69).

Referring again to FIGS. 4 and 5, a connection fitting 100 may be included between an outlet of the dispensing system reservoir 60 and the manifold 50. The manifold 50 may be fixedly attached to the grounded structure 80, which is to say that the manifold 50 remains stationary and the dispensing system reservoir 60 is moveable. The connection fitting 100 may be designed to expand and/or contract to provide a substantially fluid tight seal through the range of movement of the dispensing system reservoir 60. In an example, the connection fitting 100 may be configured as a bellows having walls that fold together. In another example, a flexible tube may be circuitously routed and connected between the reservoir outlet and the manifold 50.

The weight differentiating element 69 may comprise an electronic sensor, such as a tactile switch, an electroactive polymer switch, a strain gauge, a force sensitive resistor, etc. In an example, the strain gauge may be utilized to measure a change in electrical conductance based upon the geometry of strain gauge conductors that make up the strain gauge. For example, when the strain gauge is stretched and/or compressed (e.g., as result of a force being applied to the strain gauge), even in small increments, the electrical conductance of the strain gauge may change in a predictable manner. As such, a change in the electrical conductance of the strain gauge may be equated to a change in the force applied to the strain gauge and/or a change the amount of the fluid product within the dispensing system reservoir 60. Accordingly, a strain gauge may be used as a weight differentiating element 69 by providing strain gauge conductors between the mounting block 66 and the mounting bracket 82. The strain gauge may be configured to replace the spring 70 by functioning to elastically expand (e.g., stretch) and/or contract (e.g., compress) based upon changes in force and/or weight. In an example, the strain gauge may be mounted on an underside of the mounting block 66 and/or the mounting block 66 and/or mounting bracket 82 may be modified in any manner chosen to functionally receive the strain gauge for determining the weight of the fluid product in the dispensing system reservoir 60. An output from the strain gauge may then be communicated to the indicating system 78 for displaying the level of fluid product remaining in the dispensing system reservoir 60.

With reference to FIG. 5, dispensing system 10 may comprise a control system 170, also referred to as a controller. The control system 170 may comprise electronic circuitry 171 (e.g., a circuit board for controlling the sequence of operation of the dispensing system 10, such as the pump, an actuator, the motor, etc.). The electronic circuitry 171 may reside on a printed circuit board and/or be received in a suitable enclosure (not illustrated). In an example, an electrical power supply, such as the battery 54, may be provided to power the electronic circuitry 171.

In an example, the electronic circuitry 171 of the control system 170 may comprise digital electronic circuitry 172 designed to receive and process data relating to an operation(s) of the dispensing system 10. For example, the digital electronic circuitry 172 may function to receive input signals from the electronic key 40, electronic sensors, and/or onboard sensors 191. In another example, the digital electronic circuitry 172 may function to receive input signals from electronic sensors (e.g., tactile switches, strain gauges, etc.). The electronic circuitry 171 may utilize an analog-to-digital converter. The digital electronic circuitry 172 may comprise a programmable logic processor 173, an electronic data storage object 185, and/or memory component 186.

In an example, the digital electronic circuitry 172 may function to output a control signal utilized to control an operation of the dispensing system 10, such as an operation of the motor 53. The control signal may comprise a low voltage DC signal and/or an AC signal. Whatever the configuration, persons of skill in the art will understand the use and implementation of a wide array of circuitry as may be preferred for controlling operation of the actuators of the dispensing system 10.

In one embodiment, onboard sensors 191 may be incorporated into the fixture 14. These onboard sensors 191 can be used to detect motion for hands-free activation of the dispensing system 10 and may comprise one or more infrared (IR) emitters and/or detectors. The emitter-detector pairs may be oriented in any manner to provide consistent activation in a particular region under the nozzle 16, for example.

Figure 7:
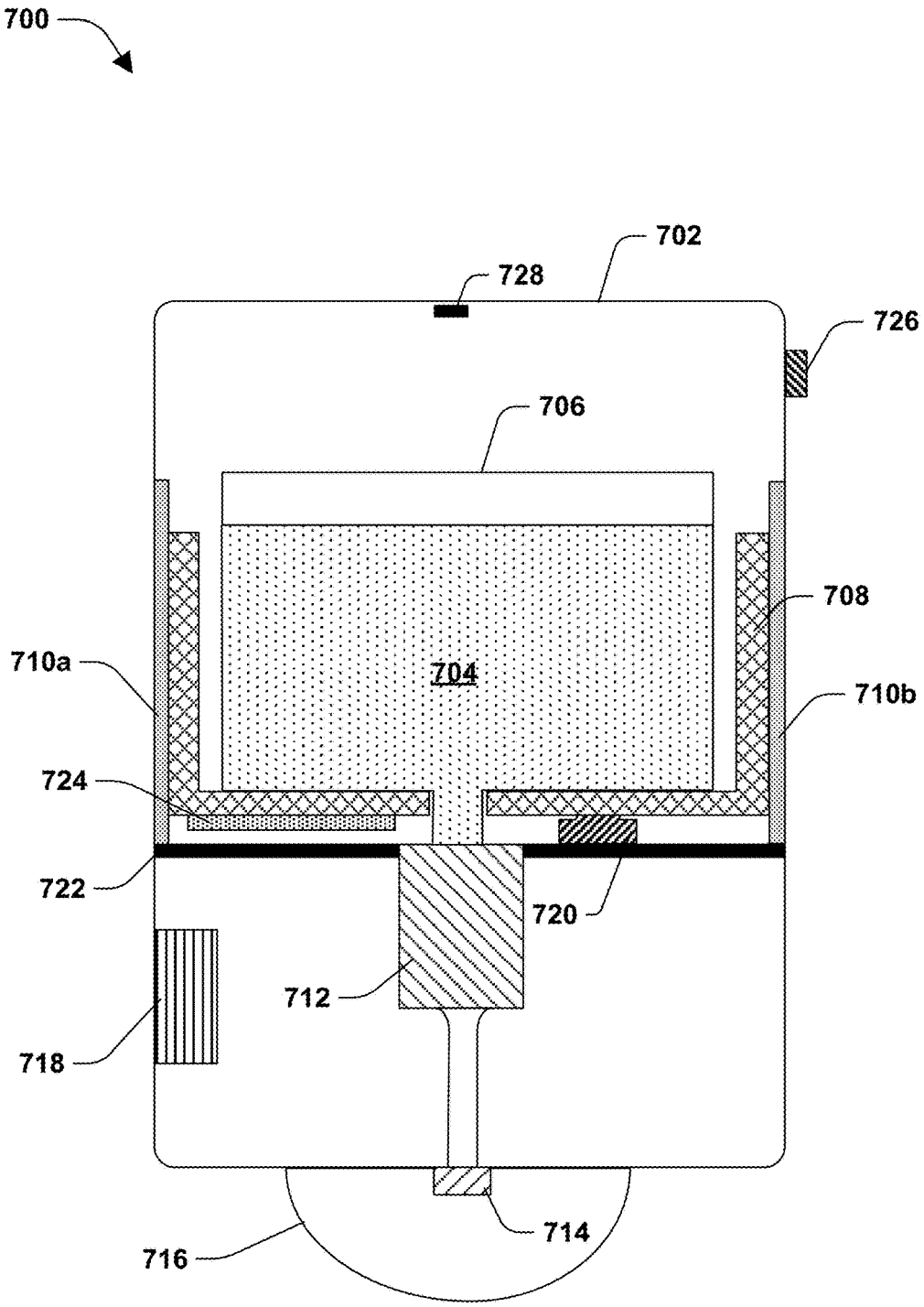
FIG. 7 is an illustration of an example of a dispensing system according to some embodiments, where an electronic sensor comprises a switch compressed based upon a weight of fluid product in a dispensing system reservoir.
Figure 8:
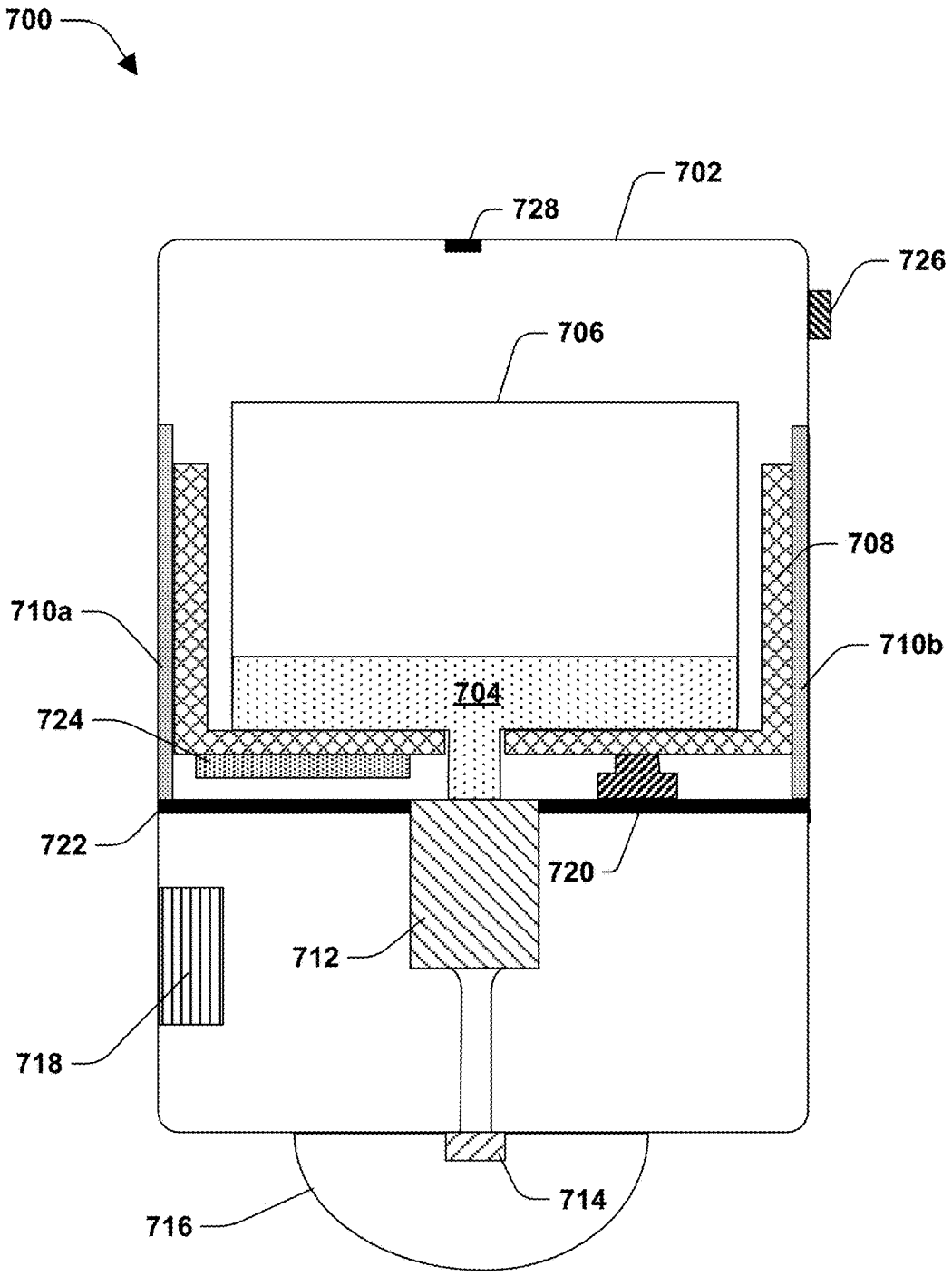
FIG. 8 is an illustration of an example of a dispensing system according to some embodiments, where an electronic sensor comprises a switch that is not compressed based upon a weight of fluid product in a dispensing system reservoir.

Turning to FIGS. 7 and 8, a dispensing system 700 is provided. In general, the dispensing system 700 may be used for storing and/or dispensing a fluid product 704.

The dispensing system 700 may comprise a housing 702. The housing 702 may comprise a wall-mount unit, a counter-mount unit, and/or a freestanding unit disposed on a countertop or the like. In an example, the housing 702 may be generally rectangular shaped. In another example, the housing 702 may comprise a counter mount dispensing system having a fixture. The fixture may comprise a fixed stem (e.g., stationary). The counter mount dispensing system may comprise a below counter assembly. The below counter assembly may be free hanging relative to the stem. The housing 702 may include any number of materials, including metals, plastics, etc. The housing 702 may include a cover that may be operatively opened and closed to gain accesses to inner components of the dispensing system 700, such as a dispensing system reservoir 706.

The dispensing system reservoir 706 may include any number of sizes, shapes, and structures. For example, the dispensing system reservoir 706 may include at least one of bottles, vessels, pouches, bags, or the like. Indeed, the dispensing system reservoir 706 illustrated in FIGS. 7 and 8 comprises only one of any number of types of containers. Likewise, the dispensing system reservoir 706 may be larger or smaller than illustrated.

The dispensing system reservoir 706 may hold a fluid product 704. The fluid product 704 may comprise any type of liquid, semi-liquid, gel, powder, foam based materials, etc. The fluid product 704 may comprise, for example, cleaning materials such as sanitizing materials, antiseptics, soaps, moisturizers, hand sanitizers or the like. In other examples, the fluid product 704 may comprise water or other non-cleaning liquid materials. Indeed, the fluid product 704 is not specifically limited to these examples, and could include any type of materials. The dispensing system reservoir 706 may be configured to contain between about 300 grams to about 2000 grams of the fluid product 704, but is not limited to the same. In some embodiments, the dispensing system reservoir 706 is a disposable refill container.

The dispensing system reservoir 706, within which the fluid product 704 is contained and from which the fluid product 704 is dispensed, may be supported by the housing 702. In an example, the housing 702 may include a movable mount 708. The movable mount 708 may be configured to slide or pivot about an axis within the housing 702. In some embodiments, the movable mount 708 may move along a rail system, which may include rails 710*a* and 710*b*. Indeed, the movable mount 708 may be sized/shaped to receive the dispensing system reservoir 706 and, in particular, may receive an opening of the dispensing system reservoir 706. In one possible example, the opening of the dispensing system reservoir 706 may be configured such that the dispensing system reservoir 706 may be adapted to be operatively coupled to a pump 712.

The pump 712 may be interposed between the dispensing system reservoir 706 and a nozzle 714. The pump 712 may function to selectively dispense a dispersion amount of the fluid product 704 from the dispensing system reservoir 706 and out the nozzle 714. The pump 712 may be in fluid communication with the fluid product 704, such that, in response to a force, the fluid product 704 may be dispensed from the dispensing system reservoir 706. The pump 712 illustrated in FIGS. 7 and 8 includes only one of any number of pumps that could be utilized in the dispensing system 700.

An actuator 716 may be configured to control the pump 712. The actuator 716 may include at least one of a touch free sensor, lever, solenoid, plunger, or the like. The actuator 716 may be configured so that when engaged, the pump 712 dispenses a dispersion amount of the fluid product 704 from the dispensing system reservoir 706. The actuator 716 may be configured to cause the pump 712 to dispense a predetermined dispersion amount of the fluid product 704 from the dispensing system reservoir 706. The predetermined dispersion amount may be between about 0.1 to about 3.0 milliliters, but is not limited to the same.

The actuator 716 may also control a motor 718 configured to drive the pump 712. The actuator 716 may be energized upon the detection of an object, such as a user's hands, positioned beneath the nozzle 714. Alternatively, the actuator 716 may be engaged manually by an object, such as the user's hands, compressing the actuator 716.

A controller 724 may be coupled to at least one of the pump 712, the actuator 716, or the motor 718. The controller 724 may also be coupled to at least one of a timer or a stroke counter (not illustrated). The controller 724 may be configured to receive information from at least one of the pump 712, the actuator 716, the motor 718, the timer, or the stroke counter. For example, the controller 724 may use the information received to determine an estimated average usage rate for the dispensing system 700 by monitoring the number of dispersion by the stroke counter over a period of time measured by the timer.

Figure 9:
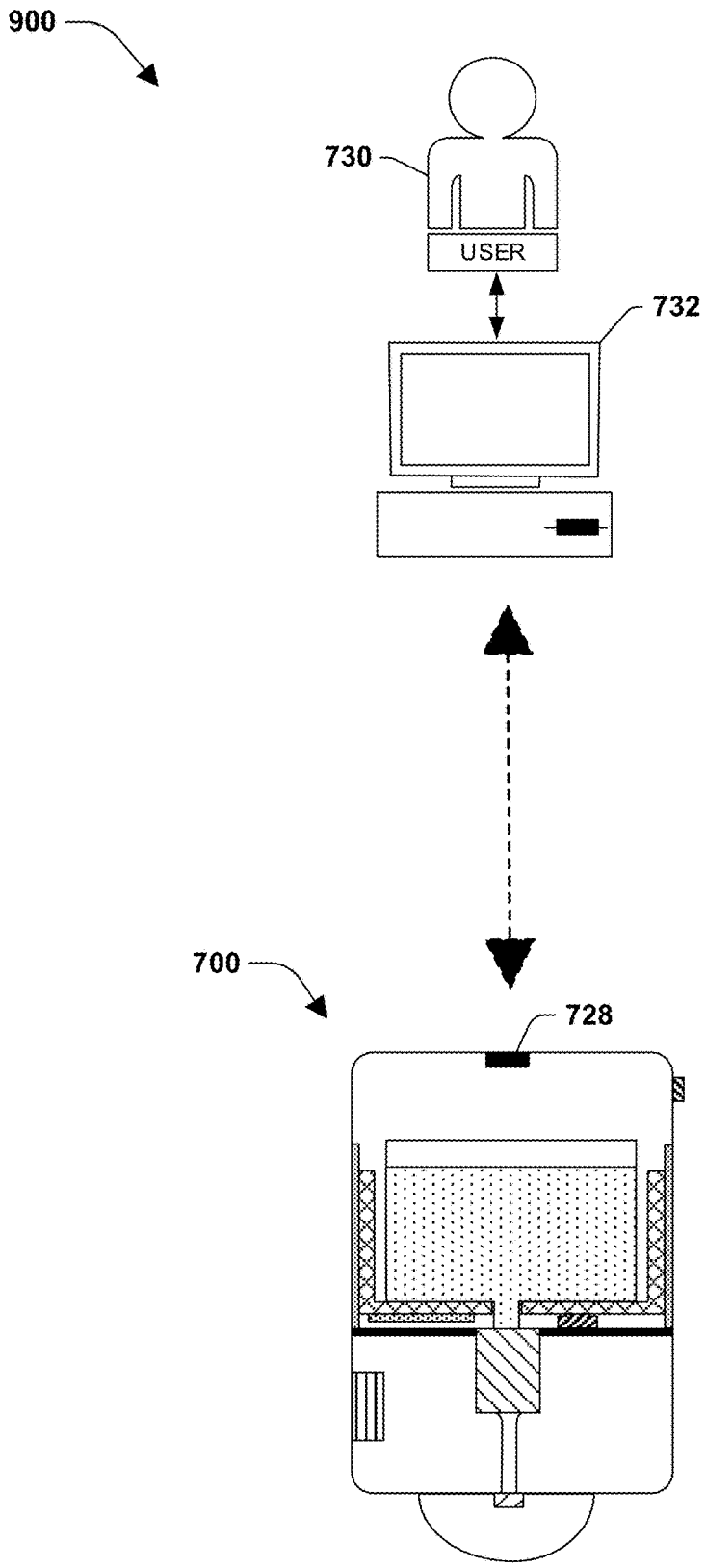
FIG. 9 is an illustration of an example wireless connection between a dispensing system and a computer according to some embodiments.

An indicator 726 may also be coupled to the controller 724. The indicator 726 may be configured to provide an indication of a condition of the dispensing system 700. For example, the indicator 726 may communicate at least one of a real time amount of the fluid product 704 in the dispensing system reservoir 706 (e.g. fill level) or a remaining service interval for the dispensing system reservoir 706 to the user. The indicator 726 may include at least one of an audio indicator, such as beep, or a visual indicator, such as a light. The indicator 726 may also include and/or be coupled to a transceiver 728 coupled to the controller 724 and configured to communicate over a network 900, as illustrated in FIG. 9. The transceiver 728 may be configured to wirelessly transmit to a user 730 an indication of a real time amount of the fluid product 704 in the dispensing system reservoir 706 via a computer 732. By way of example, in some embodiments, the computer 732 may be configured to receive information from the dispensing system 700 via the transceiver 728 and to issue instruction to the user 730 indicative of the information received (e.g. when the dispensing system reservoir 706 needs to be replaced).

A first electronic sensor 720 may also be coupled to the controller 724. The first electronic sensor 720 may be movably supported by the housing 702. As illustrated in FIGS. 7 and 8, the first electronic sensor 720 may positioned between a housing member 722 and the movable mount 708. In another embodiment, the first electronic sensor 720 may be mounted between the fixed stem of the fixture of a counter mount dispensing system and the below counter assembly (not illustrated). In this way, the weight of the below counter mount assembly may be transferred to the first electronic sensor 720. In an example, the first electronic sensor may comprise a force sensitive resistor configured to measure the weight of the fluid product 704 within the dispensing system reservoir 706 housed by the below counter mount assembly (e.g., such as by converting a compressive force to a voltage/resistance change). The first electronic sensor 720 may be configured to determine a real time amount of the fluid product 704 in the dispensing system reservoir 706. For example, the first electronic sensor 720 may be configured to detect a first change from a first amount of the fluid product 704 in the dispensing system reservoir 706 to a second amount of the fluid product 704 in the dispensing system reservoir 706 based upon the force being applied to the first electronic sensor 720 from the weight of the fluid product 704 in the dispensing system reservoir 706. The first electronic sensor 720 may comprise a switch movable between a first switch position (illustrated in FIG. 7), in which the switch is compressed when the dispensing system reservoir 706 contains the first amount of the fluid product 704 having a first weight, and a second switch position (illustrated in FIG. 8) in which the switch is uncompressed when the dispensing system reservoir 706 contains the second amount of the fluid product 704 having a second weight. The weight at which the switch transitions from being compressed to uncompressed indicates a threshold weight for the switch. A weight less than the threshold weight may indicate that a volume of the fluid product 704 present in the dispensing system reservoir 706 is below a threshold volume (e.g., and thus the dispensing system reservoir 706 may require to be refilled/replaced).

Figure 10:
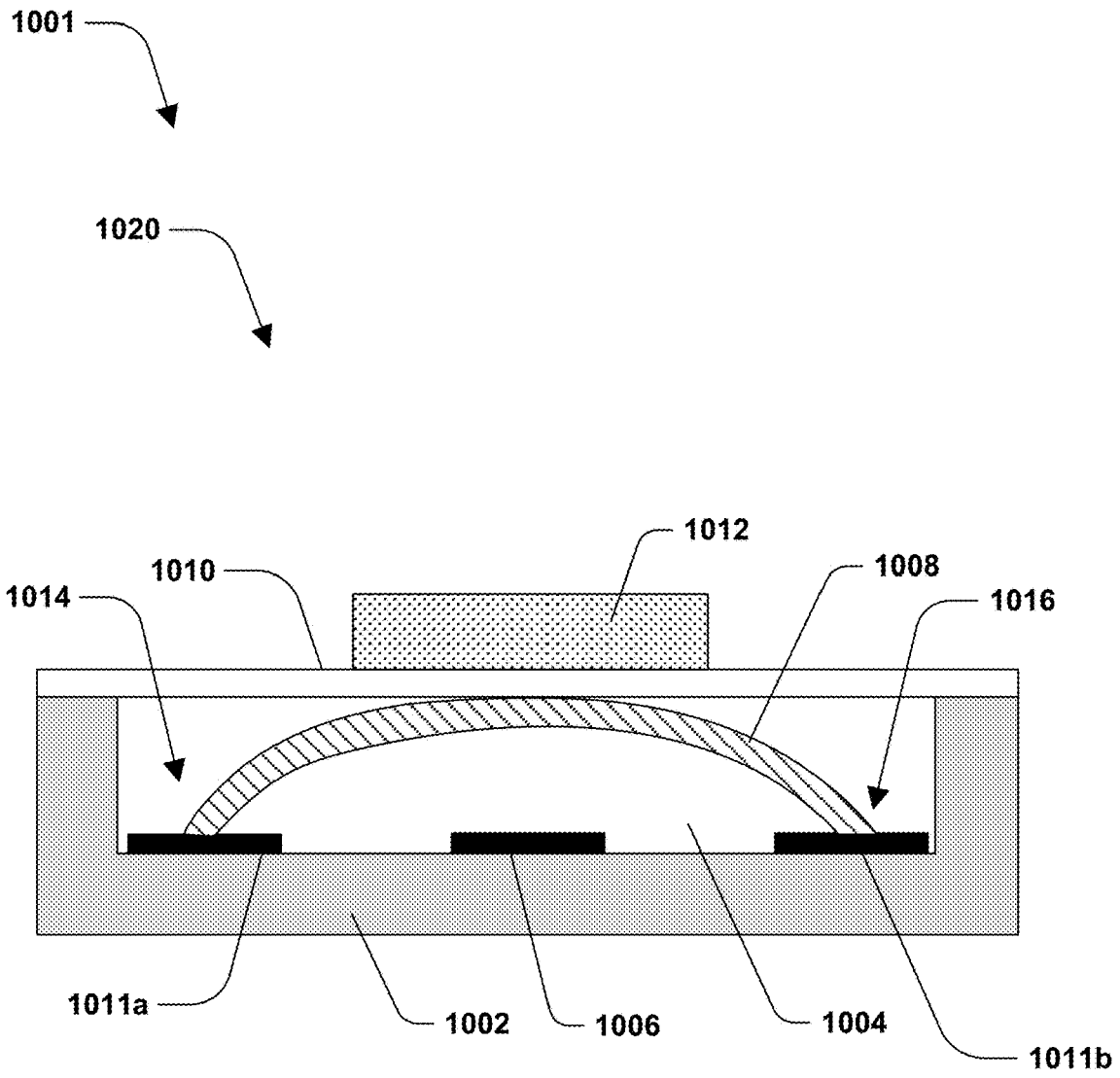
FIG. 10 is an illustration of an example electronic sensor according to some embodiments.

Turing now to FIG. 10, a cross sectional view of an example of electronic sensor 1020 for use with a dispensing system 1001 is illustrated. The electronic sensor 1020 may comprise a base 1002, a recess 1004, a fixed contact 1006, and/or a conductive member 1008. The base 1002 may be substantially rectangular shaped with the recess 1004 formed therein. The fixed contact 1006, such as an electrode, may be placed on a bottom surface of the recess 1004. The conductive member 1008, such as a click spring, may also be positioned in the recess 1004. The conductive member 1008 may be configured to oppose the fixed contact 1006 by protruding away from the base 1002. In an example, the conductive member 1008 may be substantially dome shaped having a first end 1014 contacting a peripheral contact 1011*a* and a second end 1016 contacting a second peripheral contact 1011*b*. A cover 1010 may be placed over the recess 1004 and/or the conductive member 1008. In an example, the cover 1010 may comprise elastic and be configured to deform inward (compress) upon a weight greater than a threshold weight of the electronic sensor 1020 being applied thereupon. In this example, the cover 1010 may include an engagement member 1012 configured to contact a surface, such as that of a movable mount (such as illustrated in FIGS. 7 and 8). Alternatively, the cover 1010 may be ridged and the engagement member 1012 may be configured to slide through an opening (not illustrated) in the cover 1010 to contact the conductive member 1008. In another example, the electronic sensor 1020 may comprise an electroactive polymer (EAP) fluid product and/or a force sensitive resistor (e.g., a resistor which converts compressive force to a voltage/resistance change), which may be utilized to determine the weight of fluid product presently in a dispensing system reservoir within the dispensing system 1001. In some embodiments, based upon the weight and density of the fluid product, a volume of fluid product within the dispensing system 1001 may be determined. In some embodiments, as will be described in more detail below, a more binary approach is taken, where a determination is made whether the weight of the fluid product presently in the dispensing system reservoir exceeds or does not exceed the threshold weight. When the weight of the fluid product is less than threshold weight, the dispensing system reservoir 706 may require maintenance (e.g., a refill of fluid). When the weight of the fluid product is equal to or greater than the threshold weight, the dispensing system reservoir 706 may not require maintenance (e.g., or may not require a refill of fluid).

Figure 11A:
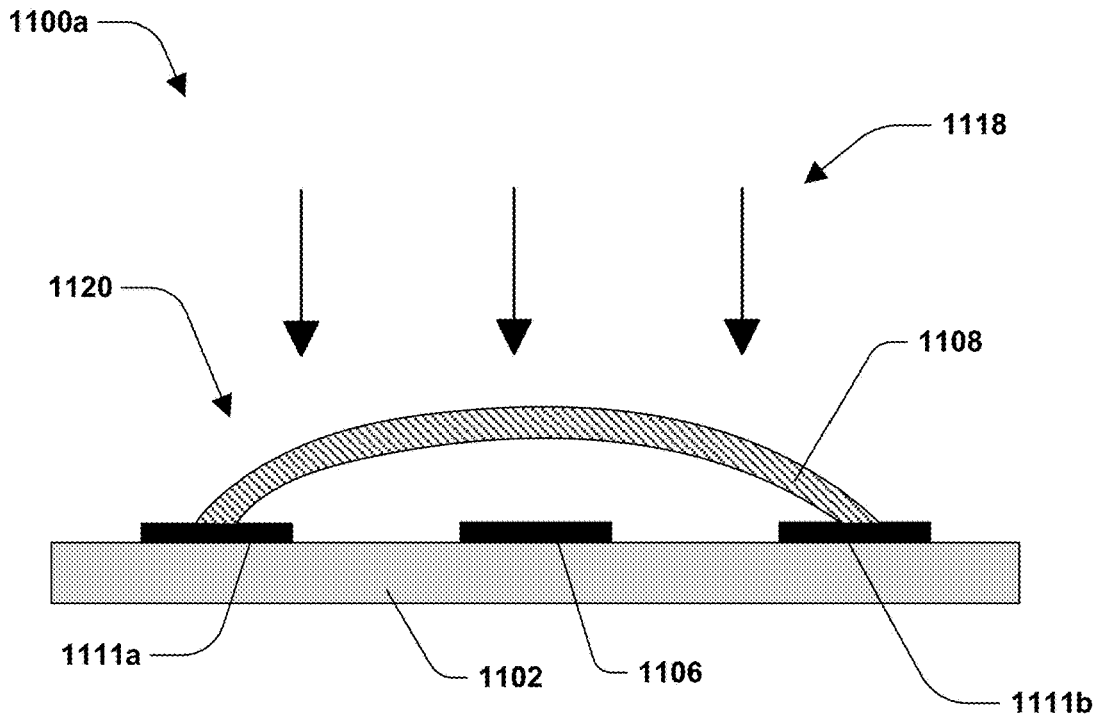
FIG. 11A is an illustration of an example electronic sensor according to some embodiments, where the electronic sensor comprises switch in an OFF state.
Figure 11B:
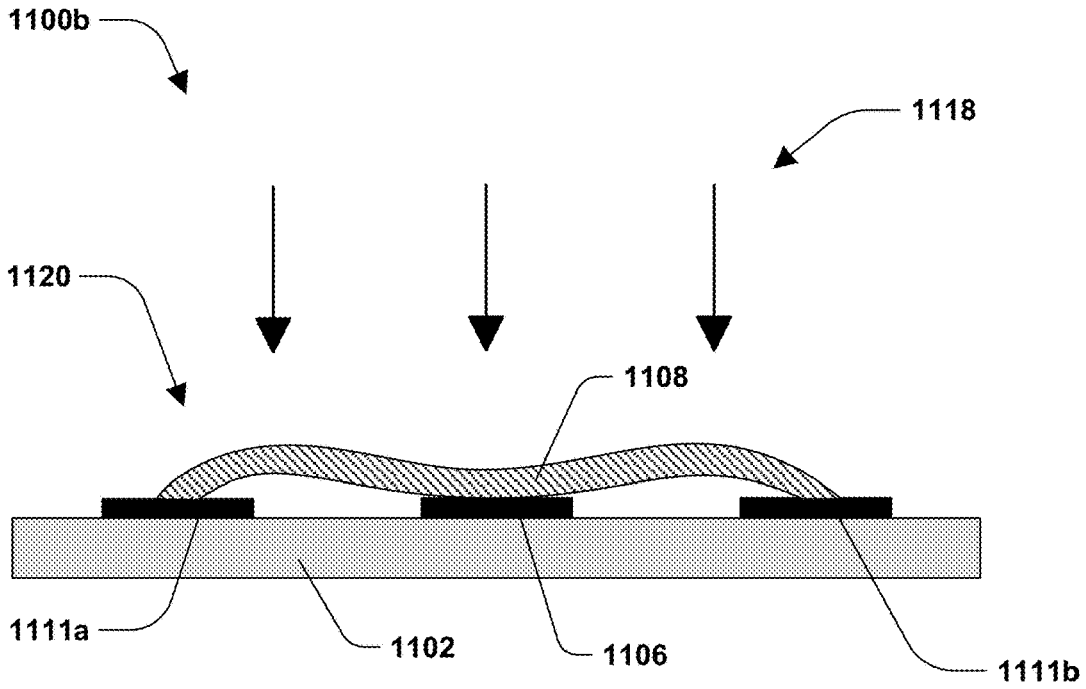
FIG. 11B is an illustration of an example switch according to some embodiments, where the electronic sensor comprises a switch in an ON state.

FIGS. 11A and 11B illustrate examples of an electronic sensor 1120 in various positions and/or states in response to a weight 1118 being applied thereto. FIG. 11A illustrates an example 1100*a* wherein the electronic sensor 1120 comprises a switch that is in an OFF state. In an example, responsive to a weight 1118 not meeting the threshold weight for the switch, the conductive member 1108 may be separated from the fixed contact 1106. Thus, the fixed contact 1106 is not electrically connected to the peripheral contacts 1111*a*-1111*b* and the switch is in the OFF state.

FIG. 11B illustrates an example 1100*b* where the threshold weight turns the switch from an OFF state to an ON state. In an example, responsive to the weight 1118 being equal to and/or exceeding the threshold weight for the switch, the conductive member 1108 may collapse downward, so that the conductive member 1108 comes into contact with the fixed contact 1106. The fixed contact 1206 may become electrically connected to the peripheral contacts 1111*a*-1111*b* and the switch may transition into an ON state.

The electronic sensor 1120 may be configured such that the threshold weight corresponds to a particular level of the dispensing system reservoir. For example, the electronic sensor 1120 may be configured to have the threshold weight that corresponds to the dispensing system reservoir being filled with a set percentage, such as 5, 10, 20, 30, 50 percent, of the fluid product. By way of another example, if the dispensing system reservoir is configured to hold 1200 g of the fluid product, the electronic sensor 1120 may be configured to have, inter alia, a threshold weight of 600 g. Thus, when the dispensing system reservoir contains 600 g or more of the fluid product 104 (e.g. more than 50% full), the electronic sensor 1120 will be compressed and in the ON state. On the other hand, when the dispensing system reservoir contains less than 600 g of the fluid product the electronic sensor 1120 may become decompressed and shift to the OFF state. A controller (not illustrated) may be configured to detect the electronic sensor 1120 transitioning from the ON state to the OFF state and may communicate the real time amount of fluid product in the dispensing system reservoir to an indicator (not illustrated). In other examples, the threshold weight of the electronic sensor 1120 may be between about 25 grams to about 1000 grams, but is not limited to the same.

In yet another example, the electronic sensor 1120 may comprise a dual stage switch configured to detect a second change from the first amount to a third amount of the fluid product. The electronic sensor 1120 may send a first signal to the controller in response to a first threshold weight being reached and a second signal to the controller in response to a second threshold weight being reached. Thus, as fluid product is dispensed from dispensing system reservoir, the electronic sensor 1120 may communicate a first real time amount and a second real time amount of fluid product in the dispensing system reservoir to the controller. In another example, two dual stage switches may be used to give an indication of four different real time amounts of the fluid product within the dispensing system reservoir. Indeed, the electronic sensor 1120 illustrated in FIGS. 11A-11B comprises only one of any number of electronic sensors that could be employed to detect the change in the amount of the fluid product in the dispensing system reservoir.

Figure 12A:
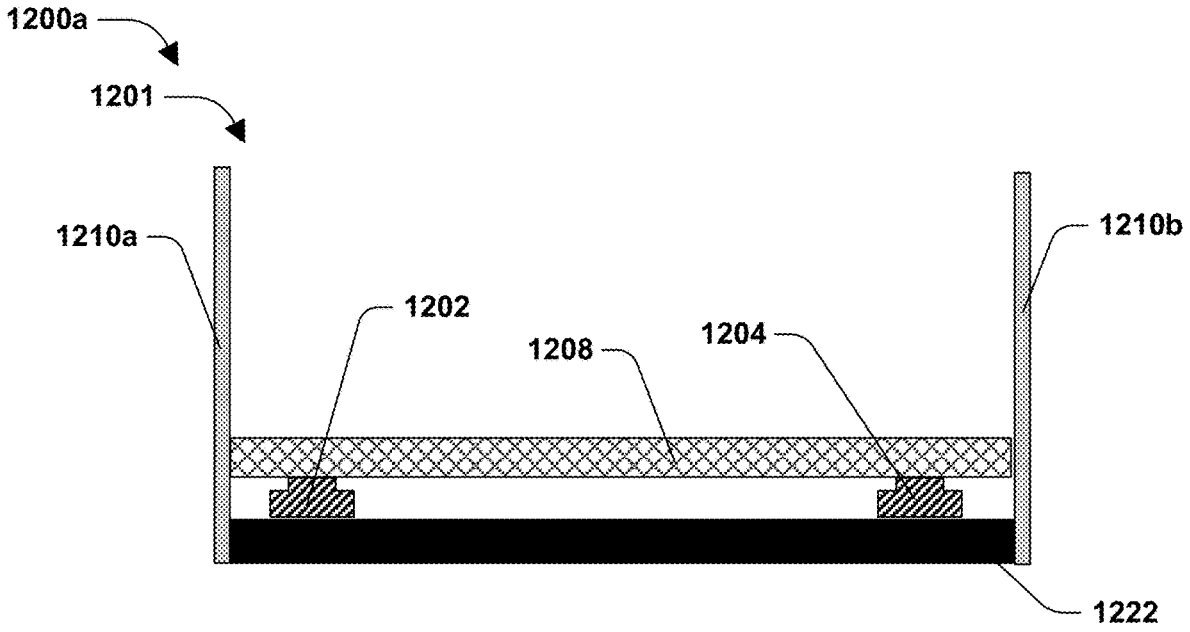
FIG. 12A is an illustration of an example of a dispensing system according to some embodiments, where the dispensing system comprises two electronic sensors mounted on a housing member.

FIGS. 12A-12F, illustrate examples of dispensing system 1201 comprising a plurality of electronic sensor. FIG. 12A illustrates an example 1200*a* of the dispensing system 1201 comprising a first electronic sensor 1202 and a second electronic sensor 1204. The first electronic sensor 1202 and the second electronic sensor 1204 may be utilized to produce an indication of at least two different real time amounts of fluid product within a dispensing system reservoir. In an example, the first electronic sensor 1202 may have a first threshold weight and the second electronic sensor 1204 may have a second threshold weight. Thus, the first electronic sensor 1202 may be configured to detect a first change, such as from a first amount of fluid product to a second amount of fluid product, and the second electronic sensor 1204 may be configured to detect a second change, such as from the first amount of the fluid product to a third amount of the fluid product. By way of example, the first electronic sensor 1202 may be configured to indicate when the dispensing system reservoir contains 500 g of fluid product and the second electronic sensor 1204 may be configured to indicate when the dispensing system reservoir contains 100 grams of fluid product. In another example, an adjustment factor may be utilized to account for various position of electronic sensors relative to the dispensing system reservoir, housing member 1222, and/or controller 1224, illustrated in FIG. 12B.

In an example, the first electronic sensor 1202 and the second electronic sensor 1204 may be fixed on the housing member 1222. The first electronic sensor 1202 may be spaced apart from the second electronic sensor 1204 so as to distribute/balance weight of the fluid product contained within a dispensing system reservoir (not illustrated). In another example, the first electronic sensor 1202 and the second electronic sensor 1204 may be spaced close together to allow for convenient placement of other components of the dispensing system 1201, such as a pump (not illustrated) and/or a controller. In an example, a movable mount 1208 may be configured to move along a rail system, which may include rail 1210*a* and/or rail 1210*b*. The movable mount 1208 may move along rails 1210*a*-1210*b* until the movable mount 1208 contacts the first electronic sensor 1202 and/or the second electronic sensor 1204. In another embodiment, the dispensing system reservoir may directly contact at least one of the first electronic sensor 1202 and/or the second electronic sensor 1204.

Figure 12B:
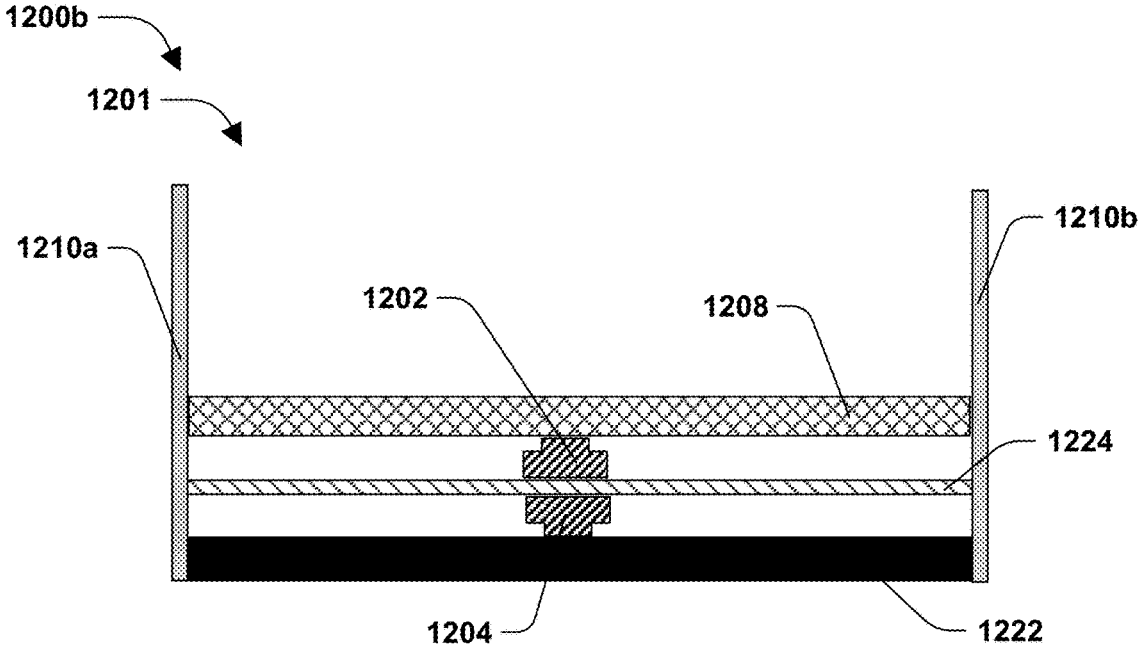
FIG. 12B is an illustration of an example of a dispensing system according to some embodiments, where the dispensing system comprises two electronic sensors mounted on opposing sides of a controller.
Figure 12C:
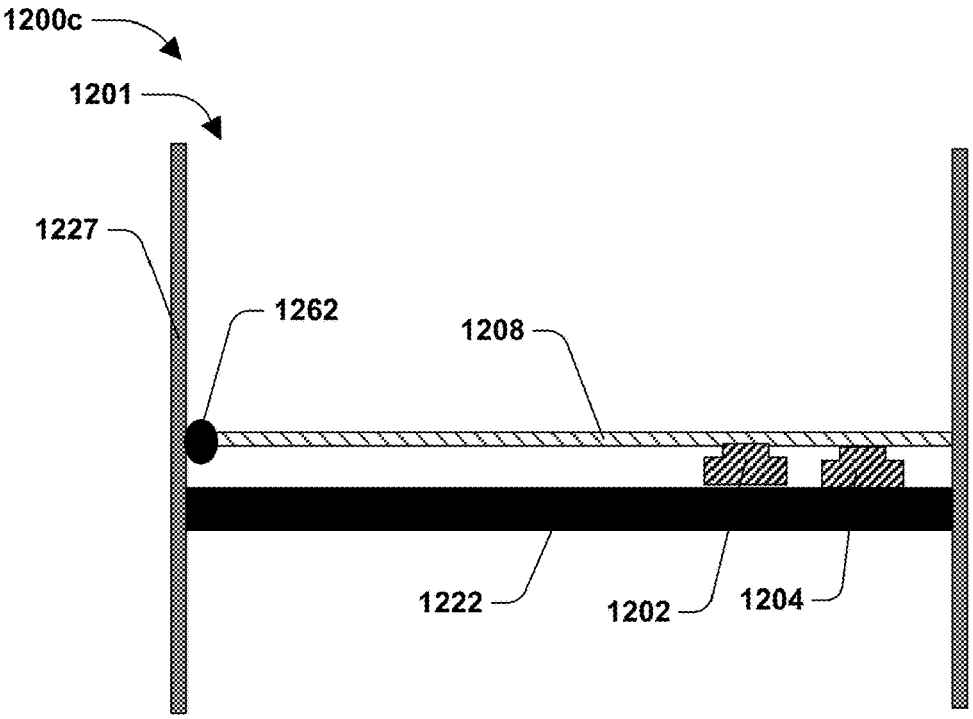
FIG. 12C is an illustration of an example of a dispensing system according to some embodiments, where the dispensing system comprises a movable mount configured to pivot about a pivot point.

FIG. 12B illustrates an example 1200*b*, wherein the first electronic sensor 1202 and the second electronic sensor 1204 may be fixed on opposing sides of a controller 1224. The controller 124 may comprise a mounting plate, a circuit board, or the like. In this example, the movable mount 1208 may contact the first electronic sensor 1202 and the second electronic sensor 1204 may contact the housing member 1222. FIG. 12C illustrates an example 1200*c*, wherein the first electronic sensor 1202 and/or the second electronic sensor 1204 may be contacted by the controller (not illustrated) and/or the movable mount 1208. In this example, at least one of the movable mount 1208 or the controller 1224 may be configured to pivot about an axis and/or pivot point 1262. The pivot point 1262 for the movable mount 1208 and/or the controller 1224 may be attached to the housing 1228. Indeed, examples 1200*a*-1200*c* are not specifically limited to these layouts, and could include any number of other layouts.

Figure 12D:
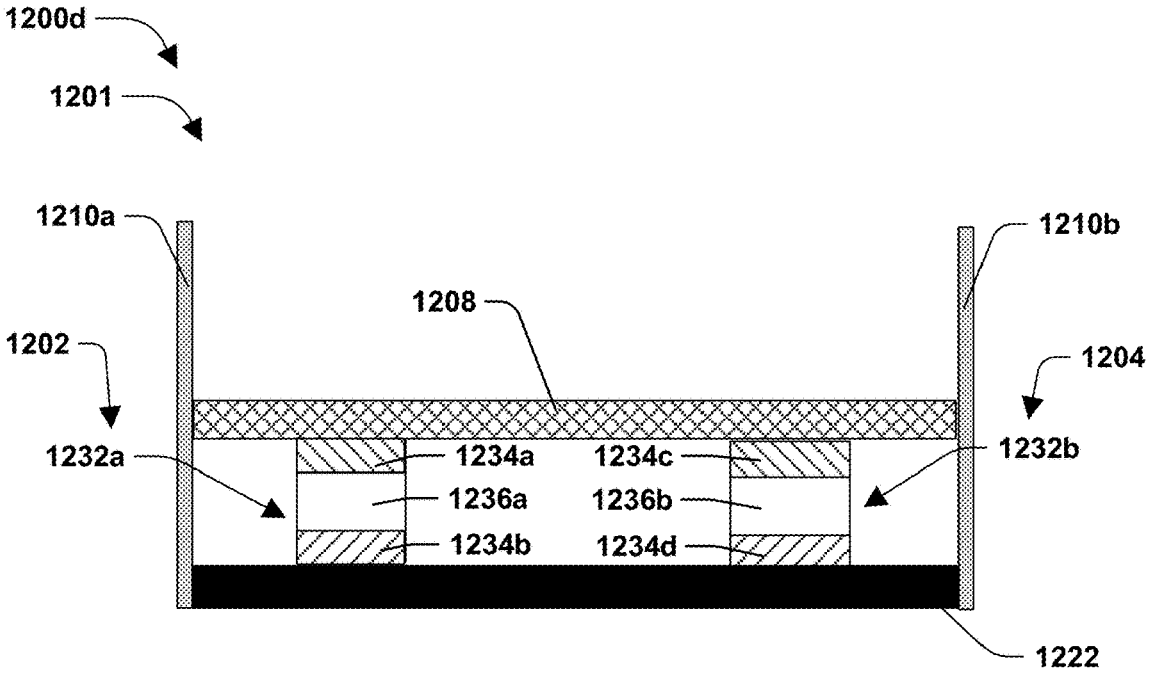
FIG. 12D is an illustration of an example of a dispensing system according to some embodiments, where the dispensing system comprises one or more electronic sensors comprising an electroactive polymer fluid product.

FIG. 12D illustrates an example 1200*d*, wherein the first electronic sensor 1202 and/or the second electronic sensor 1204 of the dispensing system 1201 may comprise an electroactive polymer (EAP) fluid product. The first electronic sensor 1202 and/or the second electronic sensor 1204 may comprise membrane 1232*a* and/or membrane 1232*b*. In an example, at least one of the membranes 1232*a*-1232*b* may be constructed from a flexible polymeric fluid product (e.g., a flexible EAP fluid product). The flexible polymeric fluid product may have a memory characteristic and/or a predetermined stiffness. In an example, membranes 1232*a*-1232*b* may become displaced in response to a force (e.g., a load provided in response to a dispensing system reservoir being placed within the dispensing system 1201) being applied thereto. For example, membranes 1232*a*-1232*b* may be fixed to the housing member 1222 and configured to become displaced when a stress is applied thereto (e.g., the membranes 1232*a*-1232*b* may be configured by selecting a flexible polymeric fluid product having a predetermined stiffness which is less than a load applied to the membranes 1232*a*-1232*b*). The stress may be applied by the movable mount 1208 and/or the controller 1224 (not illustrated) contacting at least one of the membranes 1232*a*-1232*b* in response to the dispensing system reservoir being placed thereon.

The membranes 1232*a*-1232*b* may comprise at least one of electrically conductive layers 1234*a*-1234*d* and/or dielectric layers 1236*a*-1236*b*. Electrically conducive layers 1234*a*-1234*d* may comprise an EAP fluid product, such as an EAP fluid product comprising carbon, silicone, acrylic, and/or a dielectric elastomer. In an example, electrically conductive layers 1234*a*-1234*d* is separated from different one of the electrically conductive layers 1234*a*-1234*d* by at least one of dielectric layers 1236*a*-1236*b*. Responsive to a voltage being applied to electrically conductive layers 1234*a*-1234*d*, the neighboring dielectric layers 1236*a*-1236*b* and the electrically conductive layers 1234*a*-234*d* may form a capacitor that varies in capacitance based on a stress (e.g. compression and/or stretching of the EAP fluid product) applied thereto. In an example, the electrically conductive layers 1234*a*-1234*d* may be configured to generate an output signal corresponding to an amount of stress imparted on said layer. For example, dielectric layers 1236*a*-1236*b* may be configured to change thickness and/or surface area based on the amount of stress applied to dielectric layers 1236*a*-1236*b*, which in turn changes the output signal (e.g. capacitance) of the capacitor formed from the electrically conductive layers 1234*a*-1234*d* and the dielectric layers 1236*a*-1236*b*. The capacitance may be measured using an analog to digital converter and/or by measuring an amount of time the electrically conductive layers 1234*a*-1234*d* take to reach a given voltage level at a known charge rate.

Membranes 1232*a*-1232*b* may be configured such that a given capacitance corresponds to one or more predetermined fill levels of the dispensing system reservoir. In an example, membrane 1232*a* may be configured to give an indication of a first real time amount of the fluid product in the dispensing system reservoir and membrane 1232*b* may be configured to give a second indication of a second real time amounts of the fluid product within the dispensing system reservoir. Membrane 1232*a* may be configured to output a first signal in response to reaching a first capacitance and membrane 1232*b* be configured to output a second signal in response to reaching a second capacitance. Thus, the membrane 1232*a* may be configured to detect a first change from the first amount of fluid product to the second amount of the fluid product and membrane 1232*b* may be configured to detect a second change from the first amount of the fluid product to a third amount of the fluid product.

In an example, an EAP switch may be calibrated such that a capacitance of the switch and/or output by the switch is indicative of a certain compressive force upon the switch. The compressive force may be correlated to an amount of fluid product in the dispensing system reservoir (e.g., based upon the weight, density, etc. of the fluid product). The amount of fluid product remaining in the dispensing system reservoir may thus be determined at any time and/or in real time based upon the capacitance of the switch and/or changes thereof (e.g., given that the amount of fluid product/weight of the fluid product will cause a change in the capacitance of the switch).

Figure 12E:
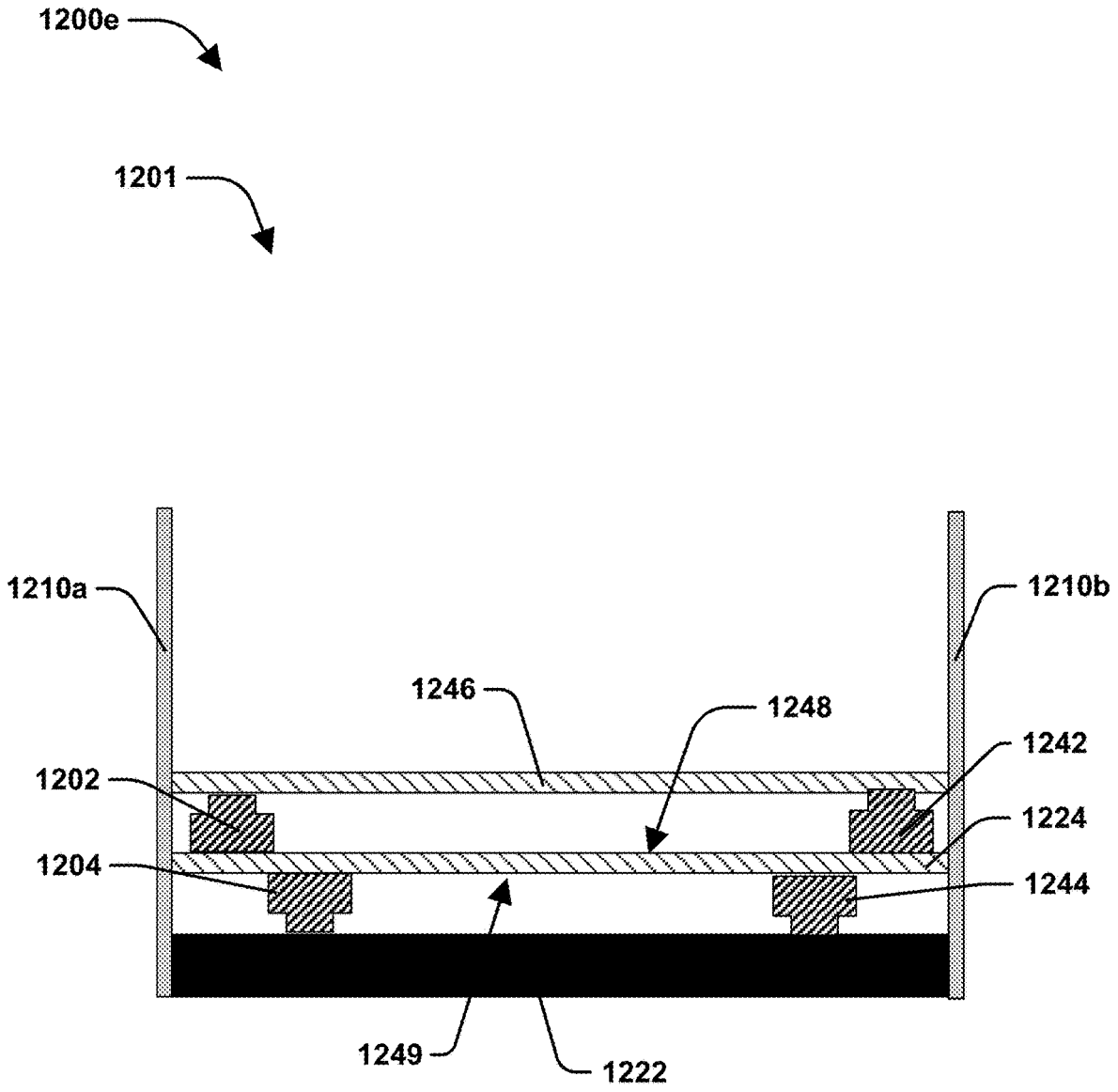
FIG. 12E is an illustration of an example of a dispensing system according to some embodiments, where the dispensing system comprises four electronic sensors mounted to a controller.

FIG. 12E illustrates an example 1200*e* of the dispensing system 1201 comprising the first electronic sensor 1202, the second electronic sensor 1204, a third electronic sensor 1242, and/or a fourth electronic sensor 1244. The electronic sensors 1202, 1204, 1242, and/or 1244 may be fixed to the controller 1224 (e.g., a circuit board). In an example, the first electronic sensor 1202 and the third electronic sensor 1242 may be fixed to a first side 1248 of the controller 1224 and the second electronic sensor 1204 and the fourth electronic sensor 1244 may be fixed to a second side 1249 of the controller 1224. A second controller 1246 (e.g., a second circuit board) may be positioned parallel to the controller 1224. The second controller 1246 may be configured to contact the first electronic sensor 1202 and the third electronic sensor 1242. In an example, the second controller 1246 may support the dispensing system reservoir (not illustrated). The first electronic sensor 1202 and the third electronic sensor 1242 may have a first threshold amount (e.g., weight, capacitance, etc.) configured to indicate a first real time amount of fluid product in the dispensing system reservoir, and the second electronic sensor 1204 and the fourth electronic sensor 1244 may have a second threshold amount configured to indicate a second real time amount of fluid product in the dispensing system reservoir. In an example, at least one of the examples 1200*a*-1200*e* of dispensing system 1201 may be utilized to determine a remaining service interval for the dispensing system reservoir (not illustrated) within the dispensing system 1201. The utilization of the electronic sensors 1202, 1204, 1242, and/or 1244 of examples 600*a*-600*e* may improve the accuracy and/or efficiency of determining the service interval for a dispensing system by accounting for discrepancies in an output volume from a dispensing system, such as those which result from clogged and/or damaged pumps.

Figure 13:
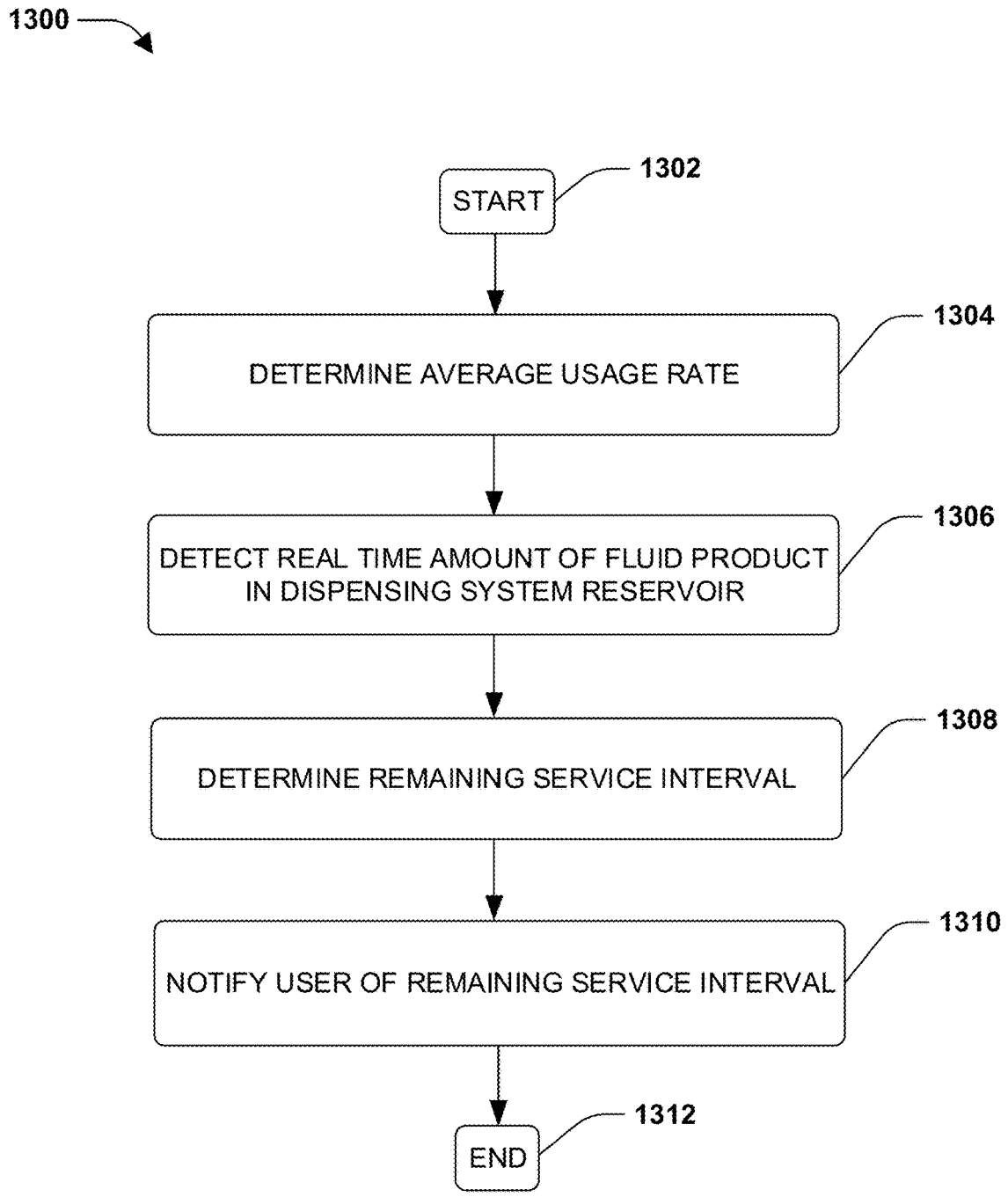
FIG. 13 is an illustration of an example method for determining a remaining service interval according to some embodiments.

Turning now to FIG. 13, an example method 1300 for determining a remaining service interval of a dispensing system reservoir is illustrated. The method 1300 may be used in association with some or all of the features illustrated in FIGS. 1 to 12F. At 1302, method 1300 starts. At 1304, an average usage rate may be determined for a dispensing system. In some embodiments, the average usage rate may be determined by monitoring (e.g., identifying) a number of dispersions from the dispensing system over a period of time (e.g., number of dispersions per minute, per hour, per day, per week, etc.). Because the dispersions from the dispensing system may have a predetermined dispersion amount, a rate (e.g., average usage rate) for a dispensing system in a specific location, such as an airport, a rural gas station, and/or a hospital, may be calculated. At 1306, a real time amount of fluid product in the dispensing system reservoir may be detected. An electronic sensor, such as a switch (e.g., tactile switches, electroactive polymer switches, etc.), a strain gauge, a force sensitive resistor, etc. may be utilized to determine the real time amount of fluid product in the dispensing system reservoir. In an example, the electronic sensor may detect a change from a first amount of fluid product to a second amount of fluid product in the dispensing system reservoir. For example, a tactile switch having a first threshold weight may be utilized to detect the change from the first amount to the second amount of fluid product. In some embodiments, when the threshold weight of the first switch is reached, a first signal is sent to a controller to indicate a real time weight of the fluid product in the dispensing system reservoir. At 1308, the remaining service interval may be determined for the dispensing system reservoir. In an example, the remaining service interval may be calculated based upon the real time amount of the fluid product in the dispensing system reservoir and/or the average usage rate for the dispensing system. At 1310, a user may be notified of the remaining service interval. For example, the user may be notified of a point in time (e.g., a day, a time of day, a range of time, etc.) when the dispensing system reservoir is predicted to need service (e.g., when the dispensing system reservoir will be empty or is likely to be empty). The user may be notified by an indication system of the dispensing system. In an example, the indication system and/or the dispensing system may send the user a notification (e.g., email, text, push notification, etc.) through a wireless connection (e.g., a Wi-Fi connection, a cellular connection, etc.). The notification may indicate a refill time range (e.g., a day, a week, a month, etc., when the dispensing system reservoir may need to be refilled and/or replaced). In another example, the indication system may display a visual indicator, such as a mechanical flag, a light, an electronic read out, etc., on and/or near the dispensing system (e.g., a digital display associated with the dispensing system may be utilized to indicate that the dispensing system reservoir will need to be replaced in 3 days). Method 1300 may provide users with an accurate and/or efficient means of determine a remaining service interval for various dispensing system reservoirs in various locations. In turn, time, material, money, etc. wasted by users prematurely replacing and/or monitoring dispensing system reservoirs which do not need service may be reduced and/or the likelihood of a dispensing system being out of service, as a result of being empty, may be reduced by the present disclosure. At 1312, the method 1300 ends.

Figure 14:
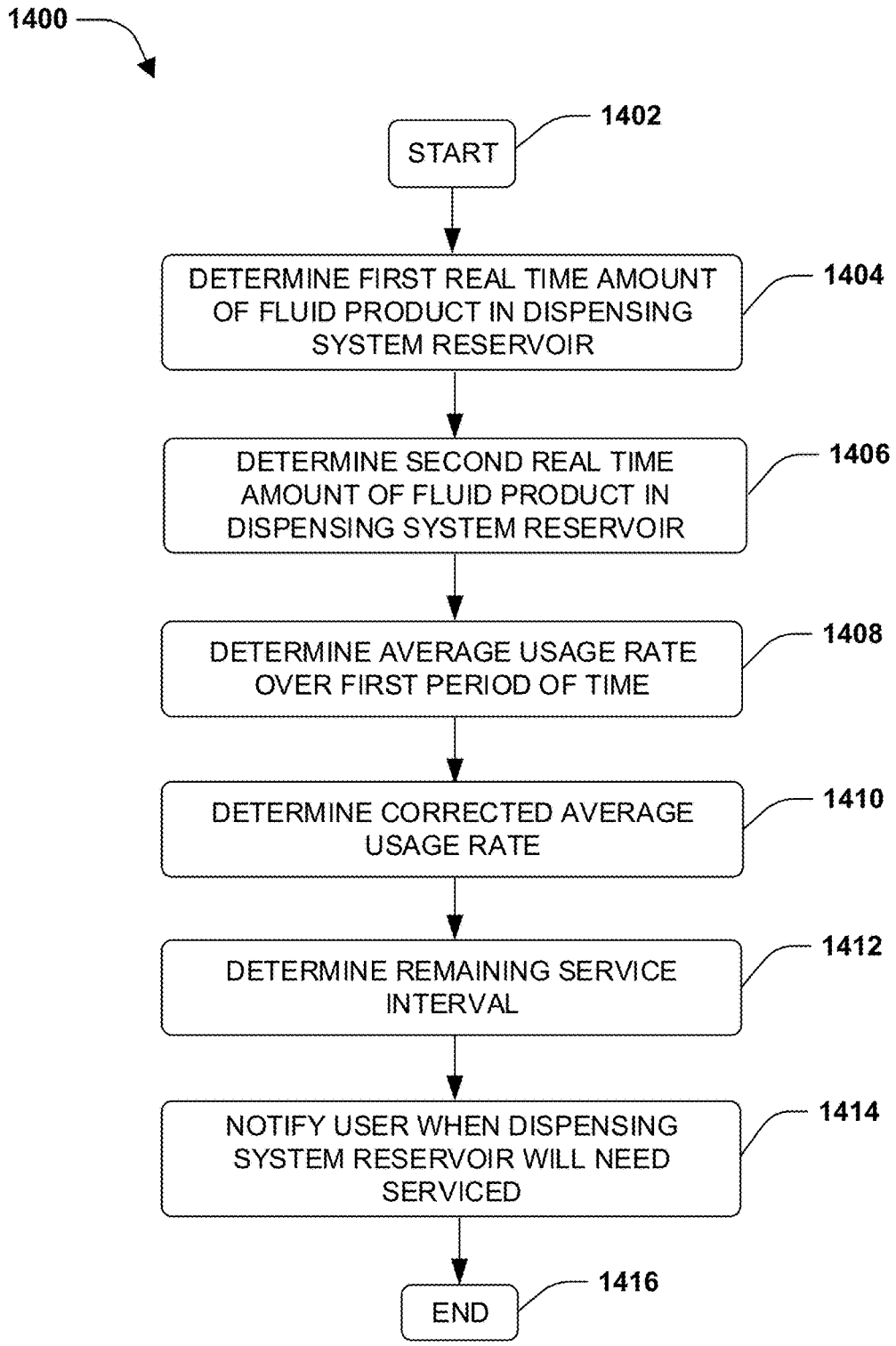
FIG. 14 is an illustration of an example method for determining a remaining service interval according to some embodiments.

Turning now to FIG. 14, an example method 1400 for calibrating a dispensing system and determining the remaining service interval for a dispensing system reservoir is illustrated. The method 1400 may be used in association with some and/or all of the features illustrated in FIGS. 1 to 13. At 1402, the method 1400 starts. At 1404, a first real time amount of fluid product (e.g., soap, lotion, etc.) in the dispensing system reservoir may be detected. In an example, the first real time amount of the fluid product may be detected at a first time. At 1406, a second real time amount of the fluid product in the dispensing system reservoir may be detected. In an example, the second real time amount of the fluid product may be detected at a second time. At 1408, an average usage rate may be determined over a first period of time. The first period of time may begin when the first real time amount of the fluid product was detected and may end when the second real time amount of the fluid product was detected. At 1410, a corrected average usage rate may be determined. In some embodiments, the corrected average usage rate accounts for the difference between the first real time amount and the second real time amount (e.g. total amount disbursed between the first time and the second time) and a calculated disbursement amount (e.g., the amount that should have been disbursed from the dispensing system based upon a predetermined disbursement amount and a number of disbursements between the detection of the first real time amount and the second real time amount). At 1412, a remaining service interval for the dispensing system reservoir may be determined utilizing the corrected average usage rate. In some embodiments, a third real time amount of the fluid product in the dispensing system reservoir may be determined to calculate the remaining service interval. At 1414, a user (e.g., service personal) may be notified of the remaining service interval. In an example, the remaining service interval may be provided as a range of time when the dispensing system reservoir may become empty and/or a range of time when the user should service the dispensing system to avoid the dispensing system reservoir running out of fluid product. At 1416, the method 1400 ends.

Figure 15:
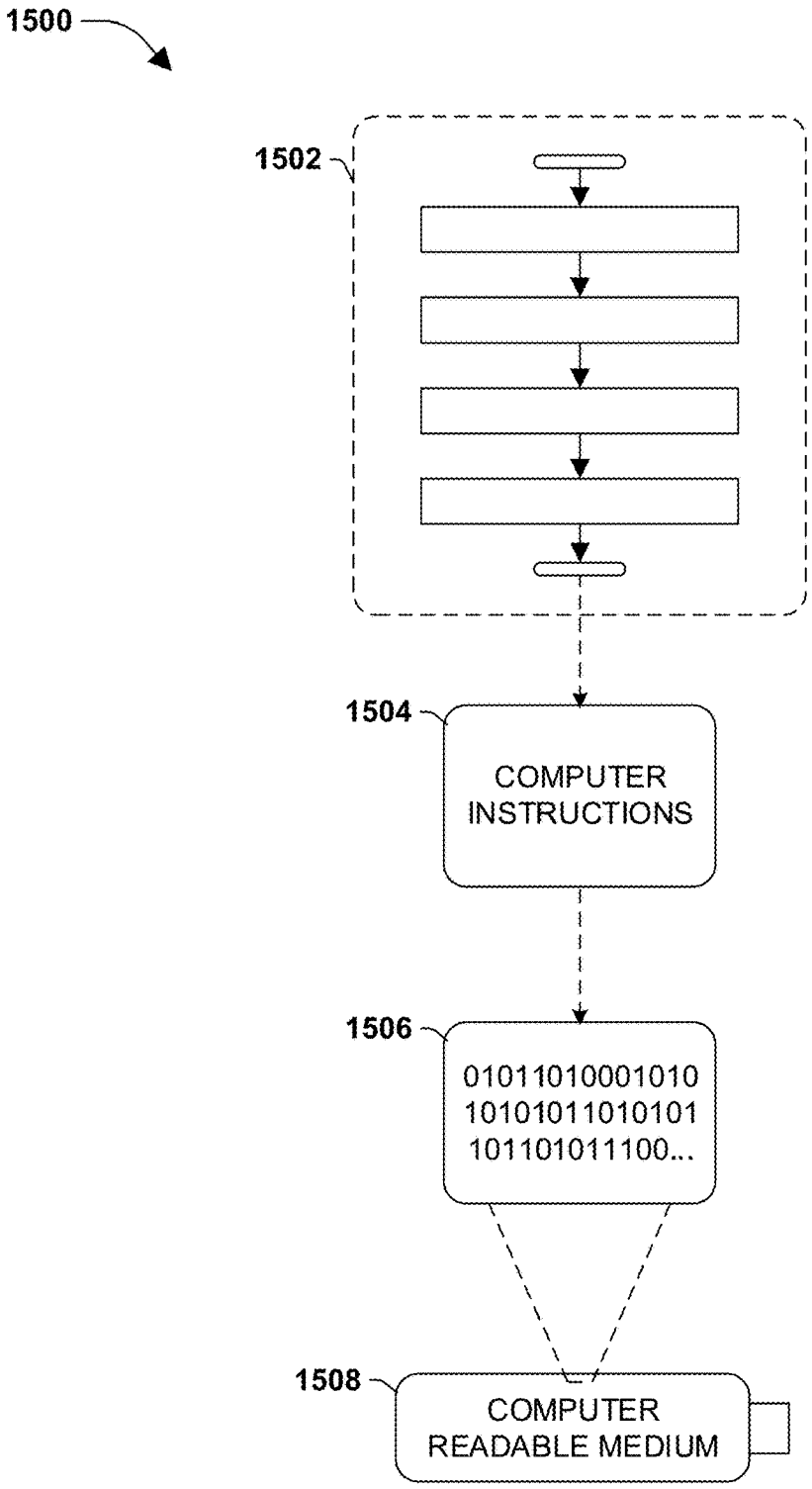
FIG. 15 is an illustration of an exemplary computing device-readable medium wherein processor-executable instructions configured to embody one or more of the provisions set forth herein may be comprised according to some embodiments.

Still another embodiment involves a computer-readable medium comprising processor-executable instructions configured to implement one or more of the techniques presented herein. An example embodiment of a computer-readable medium or a computer-readable device is illustrated in FIG. 15, wherein the implementation 1500 comprises a computer-readable medium 1508, such as a CD-R, DVD-R, flash drive, a platter of a hard disk drive, etc., on which is encoded computer-readable data 1506. This computer-readable data 1506, such as binary data comprising at least one of a zero or a one, in turn comprises a set of computer instructions 1504 configured to operate according to one or more of the principles set forth herein. In some embodiments, the processor-executable computer instructions 1504 are configured to perform a method 1502, such as at least some of the example method 1300 of FIG. 13 and/or at least some of the example method 1400 of FIG. 14, for example. In some embodiments, the processor-executable instructions 1504 are configured to implement a system, such as at least some of the dispensing system 10 of FIGS. 1-6, at least some of the exemplary dispensing system 700 of FIGS. 7-9, at least some of dispensing system 1001 of FIG. 10, and/or at least some of dispensing system 1201 of FIG. 12A-12E, for example. Many such computer-readable media are devised by those of ordinary skill in the art that are configured to operate in accordance with the techniques presented herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing at least some of the claims.

As used in this application, the terms "component," "module," "system", "interface", and/or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller may be a component. One or more components may reside within a process and/or thread of execution and a component may be localized on one computer and/or distributed between two or more computers.

Furthermore, the claimed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, many modifications may be made to this configuration without departing from the scope or spirit of the claimed subject matter.

Figure 16:
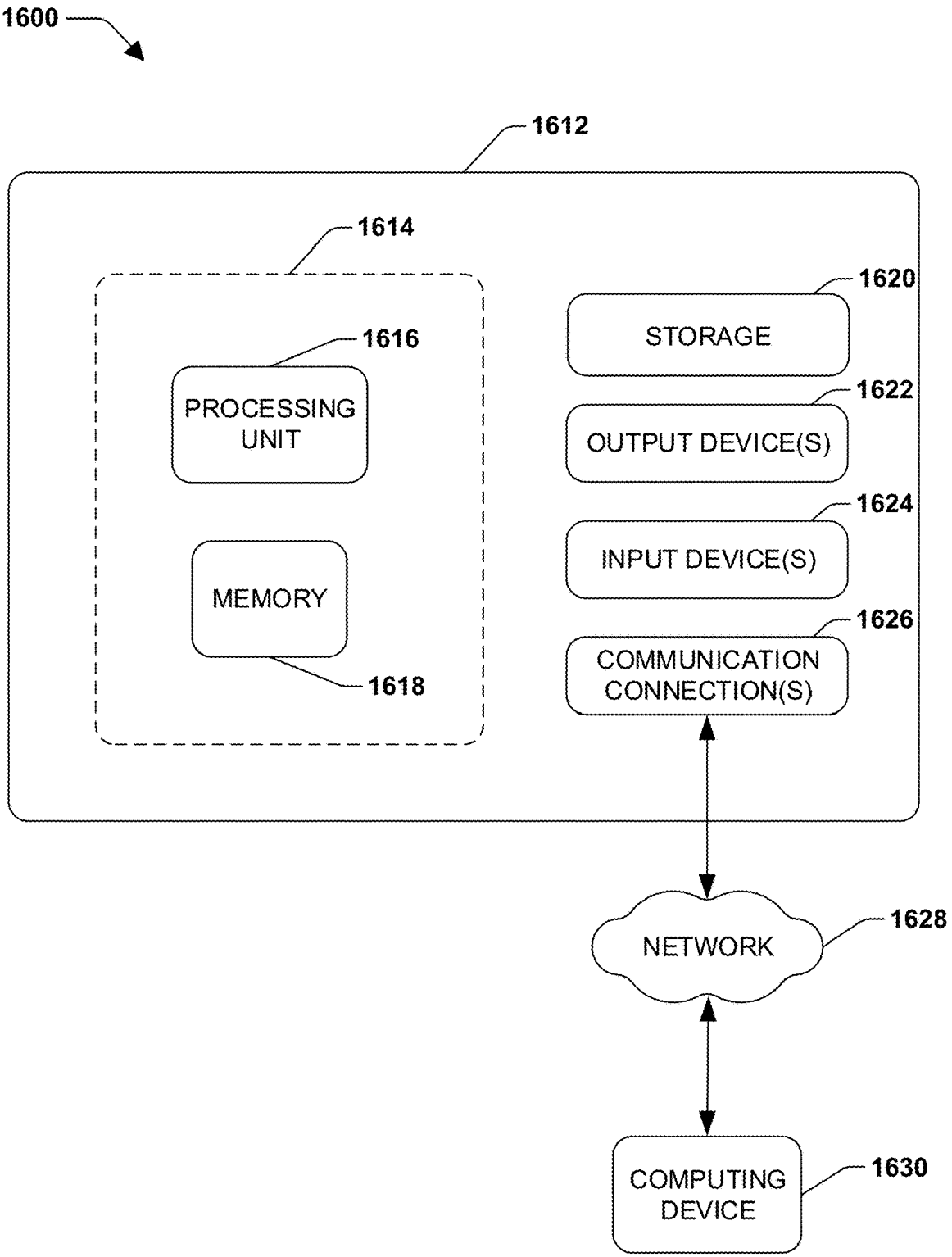
FIG. 16 illustrates an exemplary computing environment wherein one or more of the provisions set forth herein may be implemented according to some embodiments.

FIG. 16 and the following discussion provide a brief, general description of a suitable computing environment to implement embodiments of one or more of the provisions set forth herein. The operating environment of FIG. 16 is only one example of a suitable operating environment and is not intended to suggest any limitation as to the scope of use or functionality of the operating environment. Example computing devices include, but are not limited to, personal computers, server computers, hand-held or laptop devices, mobile devices (such as mobile phones, Personal Digital Assistants (PDAs), media players, and the like), multiprocessor systems, consumer electronics, mini computers, mainframe computers, distributed computing environments that include any of the above systems or devices, and the like.

Although not required, embodiments are described in the general context of "computer readable instructions" being executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

FIG. 16 illustrates an example of a system 1600 comprising a computing device 1612 configured to implement one or more embodiments provided herein. In one configuration, computing device 1612 includes at least one processing unit 1616 and memory 1618. Depending on the exact configuration and type of computing device, memory 1618 may be volatile (such as RAM, for example), non-volatile (such as ROM, flash memory, etc., for example), or some combination of the two. This configuration is illustrated in FIG. 16 by dashed line 1614.

In other embodiments, computing device 1612 may include additional features and/or functionality. For example, computing device 1612 may also include additional storage (e.g., removable and/or non-removable) including, but not limited to, magnetic storage, optical storage, and the like. Such additional storage is illustrated in FIG. 16 by storage 1620. In one embodiment, computer readable instructions to implement one or more embodiments provided herein may be in storage 1620. Storage 1620 may also store other computer readable instructions to implement an operating system, an application program, and the like. Computer readable instructions may be loaded in memory 1618 for execution by processing unit 1616, for example.

The term "computer readable media" as used herein includes computer storage media. Computer storage media includes volatile and nonvolatile, removable and non-removable media implemented in any method or technology for storage of information such as computer readable instructions or other data. Memory 1618 and storage 1620 are examples of computer storage media. Computer storage media includes, but is not limited to, RAM, ROM, EEPROM, flash memory or other memory technology, CD-ROM, Digital Versatile Disks (DVDs) or other optical storage, magnetic cassettes, magnetic tape, magnetic disk storage or other magnetic storage devices, or any other medium which may be used to store the desired information and which may be accessed by computing device 1612. Any such computer storage media may be part of computing device 1612.

Device 1612 may also include communication connection(s) 1626 that allows computing device 1612 to communicate with other devices. Communication connection(s) 1626 may include, but is not limited to, a modem, a Network Interface Card (NIC), an integrated network interface, a radio frequency transmitter/receiver, an infrared port, a USB connection, or other interfaces for connecting computing device 1612 to other computing devices. Communication connection(s) 1626 may include a wired connection or a wireless connection. Communication connection(s) 1626 may transmit and/or receive communication media.

The term "computer readable media" may include communication media. Communication media typically embodies computer readable instructions or other data in a "modulated data signal" such as a carrier wave or other transport mechanism and includes any information delivery media. The term "modulated data signal" may include a signal that has one or more of its characteristics set or changed in such a manner as to encode information in the signal.

Computing device 1612 may include input device(s) 1624 such as keyboard, mouse, pen, voice input device, touch input device, infrared cameras, video input devices, and/or any other input device. Output device(s) 1622 such as one or more displays, speakers, printers, and/or any other output device may also be included in computing device 1612. Input device(s) 1624 and output device(s) 1622 may be connected to computing device 1612 via a wired connection, wireless connection, or any combination thereof. In one embodiment, an input device or an output device from another computing device may be used as input device(s) 1624 or output device(s) 1622 for computing device 1612.

Components of computing device 1612 may be connected by various interconnects, such as a bus. Such interconnects may include a Peripheral Component Interconnect (PCI), such as PCI Express, a Universal Serial Bus (USB), firewire (IEEE 1394), an optical bus structure, and the like. In another embodiment, components of computing device 1612 may be interconnected by a network. For example, memory 1618 may be comprised of multiple physical memory units located in different physical locations interconnected by a network.

Those skilled in the art will realize that storage devices utilized to store computer readable instructions may be distributed across a network. For example, a computing device 1630 accessible via a network 1628 may store computer readable instructions to implement one or more embodiments provided herein. Computing device 1612 may access computing device 1630 and download a part or all of the computer readable instructions for execution. Alternatively, computing device 1612 may download pieces of the computer readable instructions, as needed, or some instructions may be executed at computing device 1612 and some at computing device 1630.

Various operations of embodiments are provided herein. In one embodiment, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each embodiment provided herein. Also, it will be understood that not all operations are necessary in some embodiments.

Further, unless specified otherwise, "first," "second," and/or the like are not intended to imply a temporal aspect, a spatial aspect, an ordering, etc. Rather, such terms are merely used as identifiers, names, etc. for features, elements, items, etc. For example, a first object and a second object generally correspond to object A and object B or two different or two identical objects or the same object.

Moreover, "exemplary" is used herein to mean serving as an example, instance, illustration, etc., and not necessarily as advantageous. As used herein, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B or both A and B. Furthermore, to the extent that "includes", "having", "has", "with", and/or variants thereof are used in either the detailed description or the claims, such terms are intended to be inclusive in a manner similar to the term "comprising".

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A method of determining a remaining service interval of a dispensing system reservoir, comprising:

determining a corrected average usage rate for a dispensing system by monitoring a number of dispersions over a period of time;

detecting a real time amount of fluid product in the dispensing system reservoir by detecting a first change from a first amount of fluid product in the dispensing system reservoir to a second amount of the fluid product in the dispensing system reservoir; and determining the remaining service interval of the dispensing system reservoir based upon the corrected average usage rate and the real time amount of the fluid product in the dispensing system reservoir.

2. The method of claim 1, comprising:

communicating the remaining service interval via an indicator of the dispensing system.

3. The method of claim 2, wherein the indicator comprises an audio indicator and the communicating the remaining service interval via an indicator comprises:

communicating the remaining service interval as an audio indication via the audio indicator.

4. The method of claim 2, wherein the indicator comprises a visual indicator and the communicating the remaining service interval via an indicator comprises:

communicating the remaining service interval as a visual indication via the visual indicator.

5. The method of claim 4, wherein the communicating the remaining service interval as a visual indication comprises displaying at least one of a mechanical flag, a light, or an electronic read out.

6. The method of claim 1, comprising:

communicating, via a transceiver of the dispensing system, the remaining service interval to a computer.

7. The method of claim 6, wherein the communicating the remaining service interval to a computer comprises transmitting an email comprising the remaining service interval via the transceiver.

8. The method of claim 6, wherein the communicating the remaining service interval to a computer comprises transmitting a text message comprising the remaining service interval via the transceiver.

9. A method of determining a remaining service interval of a dispensing system reservoir, comprising:

determining a first real time amount of fluid product in the dispensing system reservoir at a first time within a first period of time;

determining a second real time amount of fluid product in the dispensing system reservoir at a second time within the first period of time;

determining an average usage rate over the first period of time;

determining a corrected average usage rate of the average usage rate to account for a difference between the first real time amount and the second real time amount;

determining a remaining service interval for the dispensing system reservoir based upon the corrected average usage rate over the first period of time; and communicating, via a transceiver of a dispensing system, the remaining service interval to a computer.

10. The method of claim 9, comprising:

determining a third real time amount of the fluid product in the dispensing system reservoir at a third time within the first period of time.

11. The method of claim 10, wherein the determining the corrected average usage rate comprises determining the corrected average usage rate of the average usage rate to account for a difference between the first real time amount, the second real time amount, and the third real time amount.

12. The method of claim 9, wherein the communicating the remaining service interval to a computer comprises transmitting a push notification comprising the remaining service interval via the transceiver.

13. A method of determining a remaining service interval of a dispensing system reservoir, comprising:

determining an average usage rate for a dispensing system by monitoring a number of dispersions over a period of time;

detecting a real time amount of fluid product in the dispensing system reservoir by detecting a first change from a first amount of fluid product in the dispensing system reservoir to a second amount of the fluid product in the dispensing system reservoir;

determining the remaining service interval of the dispensing system reservoir based upon the average usage rate and the real time amount of the fluid product in the dispensing system reservoir; and communicating, via a transceiver of the dispensing system, the remaining service interval to a computer.

14. The method of claim 13, wherein the determining an average usage rate comprises:

determining a corrected average usage rate.

15. The method of claim 13, comprising:

communicating the remaining service interval via an indicator of the dispensing system.

16. The method of claim 15, wherein the indicator comprises an audio indicator and the communicating the remaining service interval via an indicator comprises:

communicating the remaining service interval as an audio indication via the audio indicator.

17. The method of claim 15, wherein the indicator comprises a visual indicator and the communicating the remaining service interval via an indicator comprises:

communicating the remaining service interval as a visual indication via the visual indicator.

18. The method of claim 13, wherein the communicating the remaining service interval to a computer comprises transmitting an email comprising the remaining service interval via the transceiver.

19. The method of claim 13, wherein the communicating the remaining service interval to a computer comprises transmitting a text message comprising the remaining service interval via the transceiver.

20. The method of claim 13, wherein the communicating the remaining service interval to a computer comprises transmitting a push notification comprising the remaining service interval via the transceiver.

* * * * *